US012385352B2

(12) United States Patent
McWilliam

(10) Patent No.: US 12,385,352 B2
(45) Date of Patent: Aug. 12, 2025

(54) ANNULUS REMEDIATION SYSTEM AND METHOD

(71) Applicant: HRG WELL SOLUTIONS LIMITED, Aberdeenshire (GB)

(72) Inventor: Gary McWilliam, Aberdeenshire (GB)

(73) Assignee: HRG WELL SOLUTIONS LIMITED, Aberdeenshire (GB)

( * ) Notice: Subject to any disclaimer, the term of this patent is extended or adjusted under 35 U.S.C. 154(b) by 0 days.

(21) Appl. No.: 18/255,074

(22) PCT Filed: Dec. 3, 2021

(86) PCT No.: PCT/GB2021/053170
§ 371 (c)(1),
(2) Date: May 30, 2023

(87) PCT Pub. No.: WO2022/118038
PCT Pub. Date: Jun. 9, 2022

(65) Prior Publication Data

US 2024/0035354 A1 Feb. 1, 2024

(30) Foreign Application Priority Data

Dec. 4, 2020 (GB) ..... 2019133

(51) Int. Cl.
*E21B 33/13* (2006.01)
*E21B 34/10* (2006.01)
(Continued)

(52) U.S. Cl.
CPC ..... *E21B 33/13* (2013.01); *E21B 34/10* (2013.01); *E21B 37/00* (2013.01); *E21B 43/112* (2013.01)

(58) Field of Classification Search
CPC ..... E21B 33/13; E21B 34/10; E21B 37/00; E21B 43/112; E21B 43/114
See application file for complete search history.

(56) References Cited

U.S. PATENT DOCUMENTS 1,789,993 A * 1/1931 Switzer ..... E21B 29/00 166/55.3
9,334,712 B2 5/2016 Bakken
(Continued)

FOREIGN PATENT DOCUMENTS

CN 11255381 A 6/2020
GB 2 499 172 A 8/2013
(Continued)

OTHER PUBLICATIONS

Holte Casing Cutter tool, Extract from The Wayback Machine https://web.archive.org/web/20101122024804/http://drilling.com/?q=node/83.
(Continued)

*Primary Examiner* — Nicole Coy
*Assistant Examiner* — Nicholas D Wlodarski
(74) *Attorney, Agent, or Firm* — Foley & Lardner LLP

(57) ABSTRACT

A BHA to be run into a wellbore to be plugged and abandoned comprises a slotting tool which further comprises an outer body having a throughbore and connections to permit the outer body to be included in the BHA and in a work string having a throughbore for sealed fluid communication with the throughbore of the outer body. A slotting blade is radially moveable towards and away from an inner surface of the wellbore to be slotted, and an activation mechanism is adapted to move the slotting blade between: a running in hole configuration in which the slotting blade is relatively retracted; and an activated configuration in which the slotting blade is extended and in use is capable of creating at least one slot in the inner surface of the wellbore such as the casing at a location in the wellbore to be plugged and abandoned.

37 Claims, 19 Drawing Sheets

(51) Int. Cl.
*E21B 37/00* (2006.01)
*E21B 43/112* (2006.01)

(56) References Cited

U.S. PATENT DOCUMENTS

| | | | | |
|---|---|---|---|---|
| 2009/0071640 | A1* | 3/2009 | Ivanov | E21B 43/112 166/55.2 |
| 2015/0053405 | A1 | 2/2015 | Bakken | |
| 2016/0194934 | A1 | 7/2016 | Bakken | |
| 2016/0258257 | A1* | 9/2016 | Babin | E21B 29/005 |
| 2017/0030157 | A1* | 2/2017 | Hansen | E21B 34/08 |

FOREIGN PATENT DOCUMENTS

| | | | | |
|---|---|---|---|---|
| GB | 2 502 504 A | 11/2013 | | |
| GB | 2 603 937 A | 8/2022 | | |
| WO | WO-2019097259 A1 * | 5/2019 | | E21B 17/22 |

OTHER PUBLICATIONS

Holte Perforators Sub-Nav, Extract from The Wayback Machine https://web.archive.org/web/20101122023401/http://drilling.com/?q=node/82.

GB Combined Search and Examination Report issued for GB App No. 2117504.7 dated May 23, 2022 (3 pages).

Notification of Grant issued for GB App No. 2117504.7 dated Feb. 7, 2023 (2 pages).

International Preliminary Report on Patentability for PCT App. PCT/GB2021/053170 dated May 30, 2023 (7 pages).

International Search Report and Written Opinion on PCT App. PCT/GB2021/053170 dated Jan. 18, 2022 (7 pages).

* cited by examiner

ANNULUS REMEDIATION SYSTEM AND METHOD

CROSS-REFERENCE TO RELATED APPLICATIONS

This application claims the benefit of priority to International Application No. PCT/GB2021/053170, filed on Dec. 3, 2021, which claims the benefit of Great Britain Patent Application No. 2019133.4, filed Dec. 4, 2020, all of which are hereby incorporated by reference in their entirety.

TECHNICAL FIELD OF THE INVENTION

The present invention relates to an annulus remediation system deployed into a wellbore and which can be used to place a lateral barrier (i.e. rock to rock) and in particular place isolation material such as a cement plug in a wellbore that is to be plugged with the intention of abandoning the wellbore. In particular the present invention allows a one trip annulus remediation system that may be deployed on a suitable string such as a drill pipe string and which allows placement of a lateral barrier without having to pull or section mill the casing or liner string and even more advantageously obviates the need for perforation guns.

In very broad summary, the present invention also relates to a novel method of slotting, whilst preferably jetting and isolating a wellbore during a plug and abandonment operation and which preferentially avoids and/or obviates the need for the use and actuation of perforating guns.

BACKGROUND OF THE INVENTION

When an oil and gas well has come to the end of its life, it is conventionally required to plug and abandon the well in order to make it safe and in so doing to ensure that the risk of any hydrocarbon leaking from the remnants of the well into the outer environment is minimised or completely prevented.

There are several conventional techniques known to be used to plug an abandoned well but one of the most commonly used involves the use of perforating guns in order to break through the casing/liner string that lines the wellbore and the perforations in the casing/liner string then allow pressurised cleaning or washing fluid to be pumped through the perforations in order to wash out the cement that is in the outer annulus behind the casing/liner string (i.e. in the annulus located between the outer surface of the casing/liner string and the inner surface of the borehole that was drilled when creating the wellbore) such that a new section of cement can be pumped down the well, through the perforations and into the annulus behind the casing/liner in order to provide a new cement barrier or similar material. The reason this is required is that it may be many years or many decades since the borehole was originally drilled and thus since the original cement job was performed and thus the cement job in the interim period may have been degregated such that unless it is replaced, the well will not be properly abandoned.

The conventional method of remediating the annulus behind the casing/liner string is as follows:—

Prior Art—Stage 1

A relatively long length of perforation guns, which may be in the region of 200 feet long, is run into the wellbore on the lower end of a drill pipe string, where a plug is located in the drill string just above the perforation guns and a pair of cups are located the drill string just above the plug. The perforating guns are run into the wellbore into the region of the wellbore which has the casing/liner string to be perforated.

Prior Art—Stage 2

The perforation guns are then activated to perforate the casing/lining string.

Prior Art—Stage 3

The perforating guns are dropped down the well by releasing them from the bottom end of the drill pipe string. Accordingly, with this prior art method, the operator requires an additional section, for example 200 feet, of the wellbore below the perforated section in order to drop the perforating guns into it and that is one disadvantage of this prior art system.

Prior Art—Stage 4

Next, the plug and hence drill pipe string is moved down approximately 200 feet in order that the plug is in line with the casing/lining string just below the perforation holes.

Prior Art—Stage 5

The plug at the now lower end of the drill pipe string is then activated in order to plug the casing/lining string throughbore just below the perforation holes.

Prior Art—Stage 6

Then, the operator pumps down cleaning/washing fluid through the throughbore of the drill pipe string (or coiled tubing string if the perforation guns/plug/cups have been run in on coiled tubing instead of a drill string) and the cleaning fluid exits the drill string through holes that are provided in the drill pipe in between the pair of cups such that the pair of cups are energised in order to seal against the inside of the casing. Thus, the fluid exits through the perforation holes in the casing/lining string and washes out the broken up cement and perforation gun debris, etc. and pumps it up to the surface firstly up the outer annulus behind the casing/liner string and then, once the cups have been moved downwards into for example the middle of the area that has been perforated, the cleaning fluid can flow back into the throughbore of the casing/lining string such that it passes up the inner annulus (i.e. between the outer circumference of the coiled tubing/drill pipe string and the inner surface of the casing/lining string), such that the washing/cleaning fluid lifts the broken up cement and other debris up to the surface.

Prior Art—Stage 7

The drill pipe/coiled tubing string is then lifted and lowered in turn up and down the 200 feet of perforation holes in the casing/lining string and over time (e.g. a few or several hours), the operator will know if the cement in the outer annulus behind the casing has been cleaned out because there will be no more pressure spikes occurring as observed by the operator at the surface of the well. As background, when the cleaning process is first started (i.e. Stage 6 as described above), the operator will see pressure spikes in the pressure of the cleaning/washing fluid as pumped down the drilling string throughbore because the fluid can't pass around the various blockages caused by the cement debris. However, once the blockages begin to be and are fully cleaned out, there will be no more blockages and therefore no more pressure spikes.

The operator can then stop pumping the cleaning fluid down the throughbore of the coiled tubing/drill pipe string.

Prior Art—Stage 8

The operator will then pump down isolation material such as cement (instead of cleaning fluid) through the throughbore of the drill string/coiled tubing string and the isolation material will exit the drill pipe/coiled tubing string through the holes positioned in between the pair of cups, such that the isolation material will then flow out through the perforation holes that were formed through the casing/lining string and into the outer annulus. Accordingly, a new cap rock will be installed in the outer annulus behind the casing/lining string by virtue of the new isolation material such as cement having been installed.

Prior Art—Stage 9

The isolation material such as cement will continue to be pumped out through the holes positioned in between the pair of cups and then out through the perforation holes and the drill pipe/coiled tubing string will be pulled upwards slowly in one run so that the isolation material starts to be pumped out from the very bottom of the well at the location where the lower most perforation holes were formed but importantly the plug that was installed below the perforation holes is left in place such that the isolation material will also fill up the throughbore of the casing/lining string as well as filling up the outer annulus behind the casing/lining string that was washed out. Accordingly, a long isolation material/cement plug that is greater in height than just the perforation holes will be formed so that the perforation holes and the outer annulus behind the perforation holes is completely filled in with the new isolation material/cement.

Prior Art—Stage 10

The drill pipe/coiled tubing string is pulled out of the wellbore and the new isolation material such as cement will then harden over time in order to provide placement of the new lateral barrier (rock to rock).

Such prior art systems are offered by Archer Oil Tools AS and also Hydra Systems AS, and are described in more detail in the following patents:—

US Patent Publication No US2016/0194934—Archer Oil Tools AS

U.S. Pat. No. 9,334,712—Archer Oil Tools AS

UK Patent No 2499172—Hydra Systems AS

UK Patent No 2502504—Hydra Systems AS

Such prior art systems that use perforation guns have the significant disadvantage that the perforation guns are by their very nature inherently dangerous due to the explosive material they contain and therefore they require a considerable number of personnel to operate them (typically five or six per rig). Accordingly, not only are they inherently dangerous and require to be surrounded by many safety systems but they are also very expensive to run and operate. In addition, the prior art methods involving perforation guns produce perforation gun gas just after detonation which needs to be circulated out of the hole to surface and which is typically vented to the atmosphere which is detrimental to the environment and also incurs significant additional time because the gas needs to be circulated out of the wellbore to ensure it is gun gas and not a hydrocarbon gas influx into the wellbore.

It is an object of embodiments of the present invention to provide an annulus remediation system for use in plug in abandonment of oil and gas wells which avoids the need for perforation gun systems and therefore avoids the disadvantages associated therewith.

SUMMARY OF THE INVENTION

According to a first aspect of the present invention there is provided a BHA to be run into a wellbore to be plugged and abandoned, the BHA comprising:—

- a slotting tool which further comprises:—
  - an outer body having a throughbore;
  - connections to permit the outer body to be included in the BHA and in a work string having a throughbore for sealed fluid communication with the throughbore of the outer body;
  - a slotting blade which is at least radially moveable towards and away from an inner surface of the wellbore to be slotted;
  - an activation mechanism adapted to move the slotting blade between:—
    - a running in hole configuration in which the slotting blade is relatively retracted; and
    - an activated configuration in which the slotting blade is extended and in use is capable of creating at least one slot in the inner surface of the wellbore at a location in the wellbore to be plugged and abandoned;
  - wherein application of pressure to fluid in liquid form in the throughbore of the outer body acts upon the activation mechanism to move the slotting blade from the running in hole configuration to the activated configuration;
  - wherein at least a portion of the slotting blade is forced through the inner surface of the wellbore to create the at least one slot therein by at least one of raising or lowering the BHA respectively up or down the wellbore; and
  - wherein the BHA further comprises a jetting function in order to jet liquid fluid toward the inner surface of the wellbore.

Typically, the BHA comprises one or more downhole tools suitably connected together but at a minimum, the BHA comprises the slotting tool alone. Preferably, the inner surface of the wellbore comprises an inner surface of an open hole section of the wellbore or more preferably comprises an inner surface of a casing or liner string or production tubing to be slotted.

According to a second aspect of the present invention there is provided a method of plugging and abandoning a wellbore, the method comprising the steps of:—

- running a BHA comprising a slotting tool in accordance with the first aspect of the present invention on a work string into the wellbore; and
- pressuring up at surface fluid in liquid form and pumping said fluid in liquid form down the throughbore of the work string and applying said pressurised fluid to the activation mechanism to move the slotting blade from the running in hole configuration to the activated configuration; and
- at least one of raising or lowering the BHA respectively up or down the wellbore to force at least a portion of the slotting blade through the inner surface of the wellbore to form the at least one slot therein.

Typically, the wellbore is either a hydrocarbon wellbore such as a production oil and/or gas well or a gas storage well or a water injector wellbore that was previously used to inject water into the lowermost region of a hydrocarbon well in order to lift the hydrocarbons or any other suitable wellbore such as a geothermal well that has come to the end of its life and requires to be plugged and abandoned. The inner surface of the wellbore is hereinafter referred to as the inner surface of the casing for brevity.

The slot formed by the slotting blade may be one relatively long continuous slot (which may be a linear/longitudinally/vertically arranged slot or may be a helically formed slot) or more preferably may be a plurality of longitudinally spaced apart slots. Typically, the one or more slots formed by the slotting blade may be a puncture or cut or hole formed by the slotting blade through the inner surface of the wellbore. Preferably, the one or more slots formed by the slotting blade may be longer than they are wider and may be substantially rectangular in shape. Alternatively, the one or more slots formed by the slotting blade may be any suitable shape of hole formed through the inner surface of the wellbore (such as circular, triangular, square, or any suitable shape having 5 or more sides).

Typically, the outer body of the slotting tool further comprises a ramp formed therein wherein the ramp comprises a longitudinal axial length and is preferably further comprises an angled longitudinal axial length such that one end of the ramp is radially further inwards (with respect to the central longitudinal axis of the slotting tool) than the other end. Typically, the angle of the ramp is linear or constant along its longitudinal axial length.

Typically, the activation mechanism is selectively actuable to move the slotting blade radially:— a) away from the central longitudinal axis of the slotting tool and towards the casing to be slotted and into the activated configuration; and b) toward the central longitudinal axis of the slotting tool and away from the casing to be slotted and into the running in hole configuration in which the outer diameter of the slotting blade is relatively retracted towards or more preferably within the outer diameter of the outer body of the slotting tool.

Typically, the activation mechanism comprises a connecting member such as a piston rod and which is preferably coupled at one end to the slotting blade.

Typically, the activation mechanism further comprises a piston and a cylinder, wherein the piston is located in the cylinder and is sealed thereto such that the piston can be forced to move by application of pressure of liquid fluid located in the throughbore of the slotting tool. Preferably, the piston comprises two faces, a first face of which is in fluid communication with the liquid fluid located in the throughbore of the slotting tool and a second face of which is sealed from the liquid fluid located in the throughbore of the slotting tool and is preferably connected to the connecting member.

Preferably, the connecting member of the activation mechanism is coupled at its other end to the piston and more preferably is coupled to a face of the piston.

Typically, the activation mechanism is arranged such that an increase in the pressure of liquid fluid at the surface of the wellbore by the operator results in an increase in the pressure of liquid fluid in the throughbore of the slotting tool which forces the piston to move within the cylinder and which forces the slotting blade to move from said one end of the ramp to the said other end of the ramp and in so doing moves the slotting blade both vertically along the ramp in a direction parallel to the central longitudinal axis of the slotting tool and simultaneously in a direction radially outwards with respect to the central longitudinal axis of the slotting tool.

Preferably, the activation mechanism further comprises a return device to assist in return of the slotting blade from the activated configuration into the running in hole or retracted configuration, typically upon reduction of the pressure of liquid fluid at the surface of the wellbore by the operator. More preferably, the return device comprises a biasing device adapted to bias the piston away from the activated configuration into the running in hole or retracted configuration. Most preferably, the biasing device acts between the piston head and the outer body of the slotting tool such that the slotting blade is biases towards the said one end of the ramp.

The method of plugging and abandoning a wellbore may further comprise arranging the slotting tool in a pushing slotting configuration at surface prior to being run into the wellbore.

The skilled reader will understand that pushing the slotting tool downwards into the wellbore can be achieved by the operator actively pushing downwards on or letting down weight of the work string at the surface thereof.

In a first preferred embodiment, the slotting tool is arranged in a pushing slotting configuration in which the ramp is arranged such that when the BHA is run into the wellbore, the said one (radially further inwards) end of the ramp is arranged to be vertically below the said other (radially further outwards) end such that when the slotting tool is in the activated configuration, and when the slotting tool is pushed or lowered downwards within the wellbore, the slotting blade is pushed or lowered downwards within the wellbore. This has the advantage that the reaction force between the slotting blade and the inner surface of the wellbore causes the slotting blade to be forced further along the ramp in the vertically upwards direction from said one end of the ramp toward the said other end of the ramp and is thereby further forced radially outwards to thereby increase the slotting force of the said at least portion of the slotting blade against and/or through the inner surface of the wellbore.

The method of plugging and abandoning a wellbore may further comprise arranging the slotting tool in a pulling slotting configuration at surface prior to being run into the wellbore.

In a second preferred embodiment, the slotting tool is arranged in a pulling slotting configuration in which the ramp is arranged such that when the BHA is run into the wellbore, the said one (radially further inwards) end of the ramp is arranged to be vertically above the said other (radially further outwards) end such that when the slotting tool is in the activated configuration, and when the slotting tool is pulled or lifted upwards within the wellbore, the slotting blade is pulled or lifted upwards within the wellbore. This has the advantage that the reaction force between the slotting blade and the inner surface of the wellbore causes the slotting blade to be forced further along the ramp in the vertically downwards direction from said one end of the ramp toward the said other end of the ramp and is thereby further forced radially outwards to thereby increase the slotting force of the said at least portion of the slotting blade against and/or through the inner surface of the wellbore.

The skilled reader will understand that pulling the slotting tool upwards (towards the surface of the wellbore) can be achieved by the operator lifting or pulling upwards on on the work string at the surface thereof.

Typically, the slotting blade is generally disc shaped but more preferably further comprises a serrated or castellated outer circumference such that the slotting blade preferably comprises a number of cutting teeth which may be in the form of cutting tips which are preferably circumferentially equi-spaced around the circumference of the slotting blade and which are separated by gaps in order to increase the cutting force applied to the cutting teeth. The cutting teeth of the slotting blade may be suitably coated by a relatively hard material in order to provide a relatively hard cutting surface to aid cutting or slicing through the casing.

Preferably, jetting function is arranged to jet liquid fluid such as washing or cleaning fluid toward the casing and more preferably toward the slots created in the casing by the slotting blade. Preferably, the jetting function comprises at least one jetting port or orifice which is typically in the form of a jetting nozzle formed through the side wall of an outer body of the BHA and more preferably in the form of a jetting nozzle formed through the side wall of the outer body of the slotting tool and through which liquid fluid such as washing or cleaning fluid may be jetted and more preferably may be selectively jetted by the operator.

Preferably, the said at least one jetting port is circumferentially aligned with the slotting blade and more preferably the said at least one jetting port is longitudinally axially aligned with the slotting blade. Preferably in a first embodiment, the said at least one jetting port is located vertically above (typically in relatively close proximity thereto) the slotting blade which has the advantage that the jetting port will jet through the slots that have just been formed by the slotting blade as the slotting tool is moved vertically downwards within the casing in use, typically by the operator lowering the work string and thus the BHA deeper into the wellbore. Typically, the said at least one jetting port may comprise a single jetting port or may comprise two or more jetting ports in which case said two or more jetting ports are preferably located vertically above (typically in relatively close proximity thereto) the slotting blade more preferably in a longitudinal spaced apart relationship. Hereinafter, said at least one jetting port will be referred to for simplicity sake as a single jetting port but the skilled reader will understand that it may in fact comprise such two or more jetting ports located vertically above the slotting blade in a longitudinal spaced apart relationship.

Additionally and/or alternatively in a second (inverted) embodiment, the said at least one jetting port is located vertically below (typically in relatively close proximity thereto) the slotting blade which has the advantage that the jetting port will jet through the slots that have just been formed by the slotting blade as the slotting tool is moved vertically upwards within the casing in use, typically by the operator raising the work string and thus the BHA higher up the wellbore (i.e. moving towards the surface thereof). Typically, the said at least one jetting port may comprise a single jetting port or may comprise two or more jetting ports in which case said two or more jetting ports are preferably located vertically below (typically in relatively close proximity thereto) the slotting blade more preferably in a longitudinal spaced apart relationship. Hereinafter, said at least one jetting port will be referred to for simplicity sake as a single jetting port but the skilled reader will understand that it may in fact comprise such two or more jetting ports located vertically below the slotting blade in a longitudinal spaced apart relationship.

Typically, the slotting tool further comprises a plurality of jetting ports in the form of jetting nozzles formed around the circumference and preferably through the side wall of the outer body of the slotting tool (and which preferably form a second set of jetting ports in the BHA). Preferably, the second set of jetting ports are formed through the side wall of the outer body of the slotting tool are equi-spaced 360 degrees around the circumference of the slotting tool on the same plane perpendicular to the central longitudinal axis of the slotting tool such that all of the jetting ports in the second set will permit jetting of liquid fluid at the same vertical location in the wellbore (assuming the wellbore is vertical at that location).

Preferably, the second set of jetting ports are obturated when the slotting tool is in the running in hole configuration. Typically, the second set of jetting ports can be selectively opened by the operator into fluid communication with liquid fluid located in the throughbore of the slotting tool by a port opening mechanism. Preferably, the port opening mechanism comprises a drop device seat member which is secured to the outer body of the slotting tool by a frangible device and more preferably the frangible device may be broken or sheared by dropping a drop device at surface such that when the drop device lands on the seat member, application of liquid fluid pressure at surface is transmitted to the liquid fluid located in the throughbore of the slotting tool and which acts upon the drop device and the seat member to break or shear the frangible device and which results in disconnection of the seat member from the outer body of the slotting tool thereby uncovering the second set of jetting ports and permitting fluid communication with the liquid fluid located in the throughbore of the slotting tool.

Preferably, the BHA further comprises at least one upper sealing member located above the slotting tool and at least one lower sealing member located below the slotting tool, wherein the sealing members are arranged to selectively seal against the inner surface of the casing when required to do so. Preferably, the sealing members are arranged to seal the annulus at their location between the outer surface of the BHA and the inner surface of the casing. Typically, the said sealing members are arranged to provide a greater seal when the pressure of liquid fluid acting on their radially innermost faces increases. Typically, the said sealing members are cup seals and preferably, two cup seals are located above the slotting tool and at least one sealing member located below the slotting tool.

Preferably, the BHA further comprises a valve tool, preferably located below the said lower sealing member. Preferably the valve tool comprises:—

- a throughbore in sealed fluid communication with the throughbore of the rest of the BHA located above the valve tool; and
- a valve member operable within the throughbore of the valve tool.

The valve member preferably permits liquid fluid located in the wellbore to pass upwards through the throughbore of the valve tool and preferably continued passage upwards into the throughbore of the rest of the BHA and more preferably prevents fluid from flowing downwards through the throughbore of the valve tool. Typically, the valve member comprises a flapper valve, poppet valve or similar type of valve or indeed any suitable valve.

Preferably, the valve tool comprises an outer body and further preferably comprises a plurality of jetting ports or orifices in the form of jetting nozzles formed around the circumference and preferably through the side wall of the outer body of the valve tool (and which preferably forms a third set of jetting ports in the BHA). The jetting nozzles are typically arranged to break up material located in the outer annulus. However, it should be noted that the jetting nozzles may instead be circulation ports to permit fluid located downhole to pass therethrough in either direction when the said circulation ports are open. Alternatively, the said jetting nozzles may be a combination of jetting nozzles and circulation ports.

Preferably, the third set of jetting ports are formed through the side wall of the outer body of the valve tool are equi-spaced 360 degrees around the circumference of the valve tool on the same plane perpendicular to the central longitudinal axis of the valve tool such that all of the jetting ports in the third set will permit jetting of liquid fluid at the same vertical location in the wellbore (assuming the wellbore is vertical at that location).

Preferably, the third set of jetting ports are obturated when the valve tool is in the running in hole configuration and the valve member is permitted to be open to allow fluid located in the throughbore thereof to flow through the throughbore as the BHA is being run into the hole. Typically, the third set of jetting ports can be selectively opened by the operator into fluid communication with liquid fluid located in the throughbore of the valve tool by a valve tool port opening mechanism. Preferably, the valve tool port opening mechanism comprises a slidable sleeve or housing typically to which the valve member is pivotably mounted, wherein the slidable sleeve is secured to the outer body of the valve tool by at least one frangible device and more preferably the at least one frangible device may be broken or sheared by applying a force to the slidable sleeve with respect to the outer body of the valve member. Typically the force applied to the slidable sleeve is a downwardly directed force. Preferably, the downwardly directed force is applied to one face of the valve member when in its closed position and more preferably, the downwardly directed force is applied to one face of the valve member by an increase in fluid pressure in the throughbore of the valve tool against one face of the valve tool which is preferably an uppermost face and the increase in pressure of said fluid is increased at surface by the operator.

Preferably, when the valve member is closed by flow of fluid downwards through the throughbore of the valve tool and/or an increase in fluid pressure at surface which is transmitted to the liquid fluid located in the throughbore of the valve tool and which acts upon the said upper face of the valve member. Said increase in pressure applies a force to the upper end of the valve member and also the slidable sleeve which will break or shear the frangible device and which results in disconnection of the slidable sleeve from the outer body of the valve tool thereby uncovering the third set of jetting ports and permitting fluid communication to occur between the liquid fluid located in the throughbore of the valve tool and the third set of ports.

Optionally, at least one of, some of, most of or all of the (first) single jetting port, second and third sets of jetting ports contain jets which permit fluid to pass there through:— a) in a circulation mode up to a certain pre-determined pressure; and
b) once the required pre-determined pressure has been reached, the said jetting port will jet the fluid at a disruptive forceful rate sufficient to dislodge and/or disturb old cement or formation or other material.

More preferably, only the first single jetting port permits fluid to pass therethrough in both of the aforementioned paragraphs a) and b) and most preferably the second and third sets of jetting ports are circulation ports which permit fluid to pass therethrough without restriction once they've been respectively opened.

Preferably, the method further comprises the following steps:— a) running a BHA including a slotting tool in accordance with the first aspect of the present invention but further also comprising:—
   I. an upper cup tool;
   II. a lower cup tool; and
   III. a valve tool
   on a work string into the wellbore; and
   pressuring up at surface fluid in liquid form and pumping said fluid in liquid form down the throughbore of the work string and applying said pressurised fluid to the activation mechanism to move the slotting blade from the running in hole configuration to the activated configuration.

Preferably the method further comprises:— b) moving the BHA downwards within the wellbore such that the activated slotting blade forms one or more slots through the side wall of the casing.

Preferably the method further comprises:— c) pumping washing/cleaning fluid in liquid form from the surface through the throughbore of the work string at a pressure sufficient to pass through the single jetting nozzle of the slotting tool, in order to wash the washing/cleaning fluid through the one or more slots formed by the slotting tool.

Preferably the method further comprises:— d) increasing the pressure of the liquid fluid in the throughbore of the work string to a sufficient pressure such that a downwardly directed force is applied to the closed valve member of the valve tool and the at least one frangible device is broken or sheared by said force and the slidable sleeve is moved thereby uncovering the third set of jetting ports in the valve tool, thereby permitting increased volumes of washing/cleaning fluid in liquid form to be pumped from the surface through the throughbore of the work string at a pressure sufficient to pass through the third set of jetting nozzles of the valve tool, in order to wash the washing/cleaning fluid through the one or more slots formed by the slotting tool.

Preferably the method further comprises:— e) dropping a drop device at surface into the throughbore of the work string and landing the drop device on the drop seat of the slotting tool.

Preferably the method further comprises:— f) increasing the pressure of the liquid fluid in the throughbore of the work string to a sufficient pressure such that a downwardly directed force is applied to the drop device and seat member whereby the at least one frangible device acting between the seat member and the outer body of the slotting tool is broken or sheared by said force and the seat member and drop device are moved thereby opening the throughbore of the slotting tool by means of uncovering the second set of jetting ports in the slotting tool, thereby permitting increased volumes of washing/cleaning fluid in liquid form to be pumped from the surface through the throughbore of the work string at a pressure sufficient to pass through the second set of jetting nozzles of the slotting tool, in order to wash the washing/cleaning fluid through the one or more slots formed by the slotting tool.

Preferably the method further comprises:— g) pumping isolation material (which is preferably cement or the like) from surface into the throughbore of the work string to fill the required area of the wellbore (including both the throughbore of the casing and the washed clean annulus behind the casing) with said isolation material to a sufficient depth.

Preferably the method further comprises:— h) pull the workstring upwards until the BHA is located above the uppermost slots formed by the slotting tool and increasing the pressure of said pumped isolation material at surface (which is preferably cement or the like) into the throughbore of the work string to a sufficient pressure such that a downwardly directed force is applied to the drop device and seat member until at least one frangible device acting between a ball seat and the seat member is broken or sheared by said force and the drop device and the ball seat are moved thereby opening the throughbore of the slotted tool to the throughbore of the BHA located below the slotted tool in order to open up circulation of isolation material below the slotted tool and out through the first set of circulation ports in order obtain circulation of isolation material below the slotting tool.

Preferably the method further comprises:— i) pulling said BHA and said work string out of the hole and permitting the isolation material to set.

The accompanying drawings illustrate presently exemplary embodiments of the disclosure and together with the general description given above and the detailed description of the embodiments given below serve to explain, by way of example, the principles of the disclosure.

In the following description, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention, and is not intended to limit the invention to that illustrated and described herein. It is to be fully recognised that the different teachings of the embodiments discussed below may be employed separately or in any suitable combination to produce the desired results.

The following definitions will be followed in the specification. As used herein, the term "wellbore" refers to a wellbore or borehole that was drilled in a manner known to those skilled in the art. The wellbore may be 'open hole' or more typically is 'cased', being lined with a tubular string. Reference to up or down will be made for purposes of description with the terms "above", "up", "upward" or "upper" meaning away from the bottom of the wellbore along the longitudinal axis of a work string toward the surface and "below", "down", "downward" or "lower" meaning toward the bottom of the wellbore along the longitudinal axis of the work string and away from the surface and deeper into the well, whether the well being referred to is a conventional vertical well or a deviated well and therefore includes the typical situation where a rig is above a wellhead, and the well extends down from the wellhead into the formation, but also horizontal wells where the formation may not necessarily be below the wellhead. Similarly, 'work string' refers to any tubular arrangement for conveying liquid fluids and/or tools from a surface into a wellbore. In the present invention, coiled tubing and in particular a drill string is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited, and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the apparatus described herein and/or downhole tools are understood to include plural forms thereof and vice versa.

BRIEF DESCRIPTION OF AND INTRODUCTION TO THE DRAWINGS

Embodiments of the present invention will now be described, by way of example only and with reference to the accompanying drawings, in which:—

FIG. 1 is a schematic side view of a first preferred embodiment of an as-built Bottom Hole Assembly (BHA) in accordance with the present invention for running into a well to be plugged and abandoned in accordance with a method of the present invention, where the BHA is run in on the lower end of a suitable work string such as a drill pipe string with a swivel (such as that shown in FIG. 2(*a*)) being located above the BHA and where the BHA comprises from top to bottom:— an upper jetting cup tool having an upper set of jetting cups provided thereon, a slotting and jetting tool having a slotting blade/cutting wheel which is shown in the activated (extended) slotting/cutting configuration, a lower jetting cup tool having a lower set of jetting cups provided thereon; and an inverted float (shear) sub;

FIG. 2(*a*) is a schematic side view of one example of a conventional swivel that can be placed in the drill string at a suitable location above the BHA of FIG. 1;

FIG. 2(*b*) is a part cross-sectional side view of a first embodiment of a slotting and jetting tool in accordance with the present invention and as shown incorporated in the BHA of FIG. 1, where the slotting and jetting tool is shown with the slotting blade/cutting wheel in the activated (extended) slotting/cutting configuration (and which is shown in more detail in FIGS. 4(*a*) and 4(*b*) and referred to in the description below for Stage 7);

FIG. 2(*c*) is a part cross-sectional view of the upper pair of jetting cups of FIG. 1 being provided on the upper jetting cup tool;

FIG. 2(*d*) is a part cross-sectional side view of the lower pair of jetting cups of the BHA of FIG. 1 being provided on the lower jetting cup tool;

FIG. 2(*e*) is a cross-sectional side view of the inverted float (shear) sub of FIG. 1 being shown in the run-in hole configuration (i.e. with its flapper valve in the open position);

FIG. 2(*f*) is a cross-sectional side view of the inverted float (shear) sub of the BHA of FIG. 1 but is shown in FIG. 2(*f*) as being in the string pressured up configuration (i.e. its flapper valve is in the closed position) and also shown in schematic form in FIG. 12 and referred to in the description below for Stage 6;

FIG. 3(*a*) is a cross-sectional side view of the slotting and jetting tool of FIG. 1 but now being shown in the running in hole (RIH) configuration and therefore is shown as being in a prior to actuation configuration in that its activation piston has not been pressured up (i.e. the activation piston is not experiencing pressure because the liquid fluid in the throughbore of the slotting and jetting tool whilst it is being run into the hole is not pressured up);

FIG. 3(*b*) is a cross-sectional view of the slotting and jetting tool of FIG. 3(*a*) but being shown from a different rotational cross-section (i.e. with a 90 degrees rotational offset around the longitudinal axis) from that of FIG. 3(*a*) but which is also shown in the RIH configuration (i.e. the activation piston is not pressured up);

FIG. 4(*a*) is a cross-sectional side view of the slotting and jetting tool of the BHA of FIG. 1 in the same rotational cross sectional view as that of FIG. 3(*a*) but the slotting and jetting tool is now shown in the configuration where the activation piston is experiencing fluid pressure being applied to it (due to the fluid pressure in the throughbore of the work string has been pressured up against the closed inverted float flapper of FIG. 2(*f*)) and also shown in schematic form in FIG. 12 and referred to in the description below for Stage 7;

FIG. 4(*b*) is a cross-sectional side view of the slotting and jetting tool of FIG. 4(*a*) but being shown from a different rotational cross-section (i.e. with a 90 degrees rotational offset around the longitudinal axis) from that of FIG. 4(*a*), and therefore the slotting and jetting tool of FIG. 4(*b*) is in the same pressured up configuration as that of FIG. 4(*a*);

FIG. 4(*c*) is a side view of the piston head and piston rod (of the activation piston of the slotting and jetting tool of FIG. 2(*b*)) shown in isolation for clarity;

FIG. 4(*d*) is a side view of a slotting blade/cutting wheel mount which is used to mount the slotting blade/cutting wheel of FIG. 4(*e*) to the in use uppermost end of the piston rod of FIG. 4(*c*);

FIG. 4(*e*) is an exploded view of a slotting blade/cutting wheel and cutting hub and cutting axle, and which when brought together are mounted upon and to the wheel mount of FIG. 4(*d*);

FIG. 5 is a cross-sectional view of the inverted float (shear) sub of FIG. 2(*f*) but after the shear pins thereof have sheared, such that the liquid fluid circulation holes formed through the side wall of the inverted float (shear) sub have been opened and the inverted float (shear) sub is now in the configuration shown in FIG. 15 at Stage 26 of the method to be described below during the final jetting procedure thereof;

FIG. 6(*a*) is a cross-sectional side view of the slotting and jetting tool of FIG. 4(*a*) but where the drop ball has been dropped through the throughbore of the work string and has landed on the seat within the slotting and jetting tool 10 (but prior to the shear pins that hold the seat in place as shown in FIG. 6(*a*) having sheared) and the slotting and jetting tool is shown in the configuration described in Stage 27 of the final jetting procedure as shown in FIG. 16;

FIG. 7(*b*) is a cross-sectional view of the slotting and jetting tool of FIG. 7(*a*) but being shown from a different rotational cross-section (i.e. with a 90 degrees rotational offset around the longitudinal axis) from that of FIG. 7(*a*);

Figure 1:
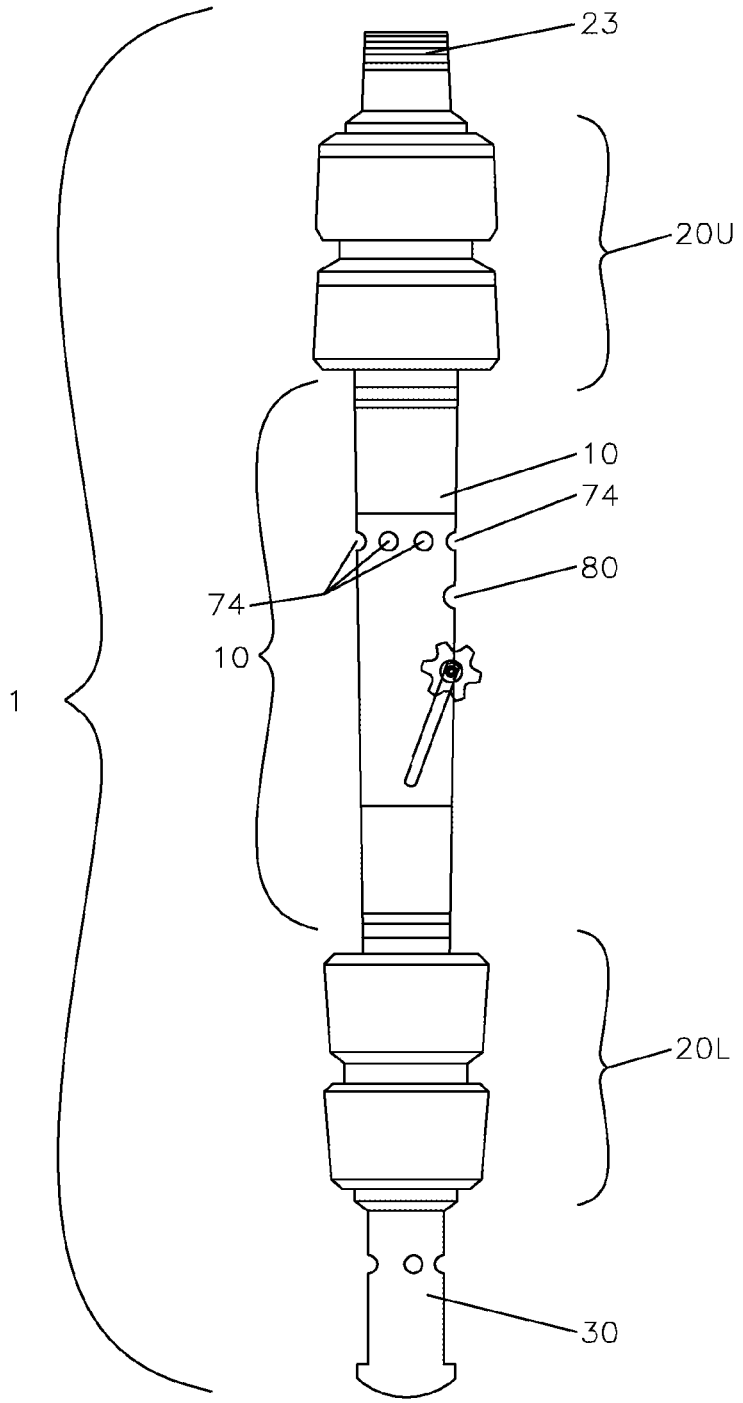
Figure 2D:
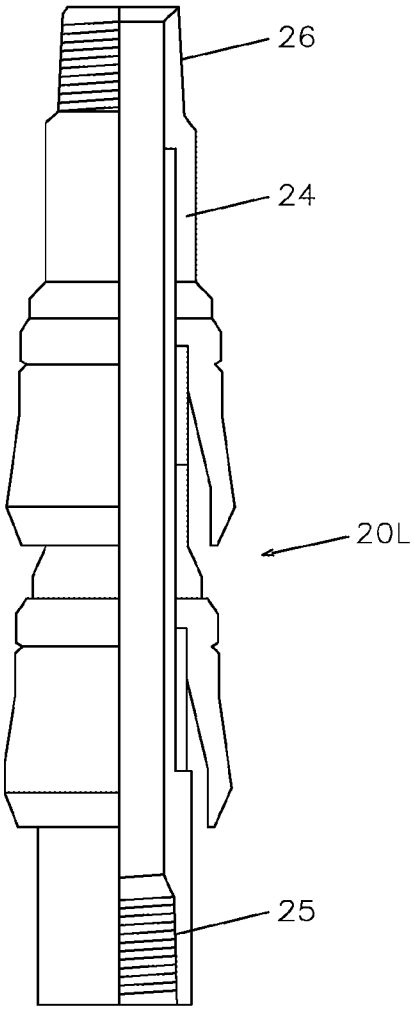
Figure 2C:
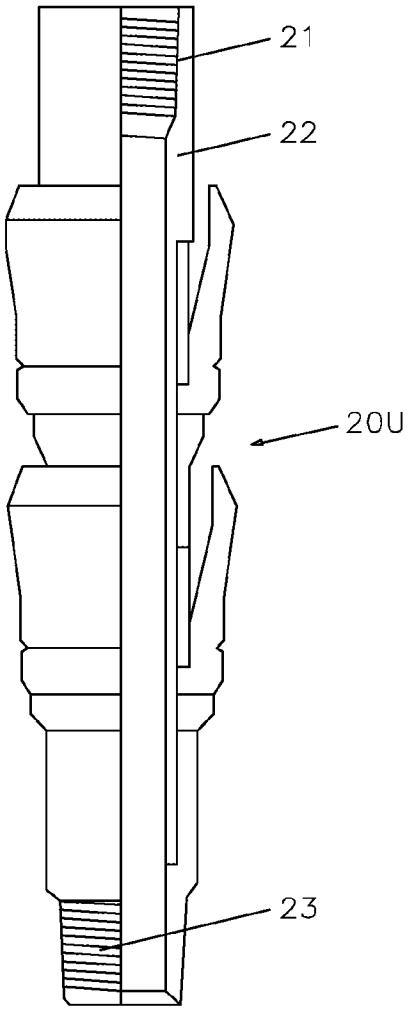
Figure 2B:
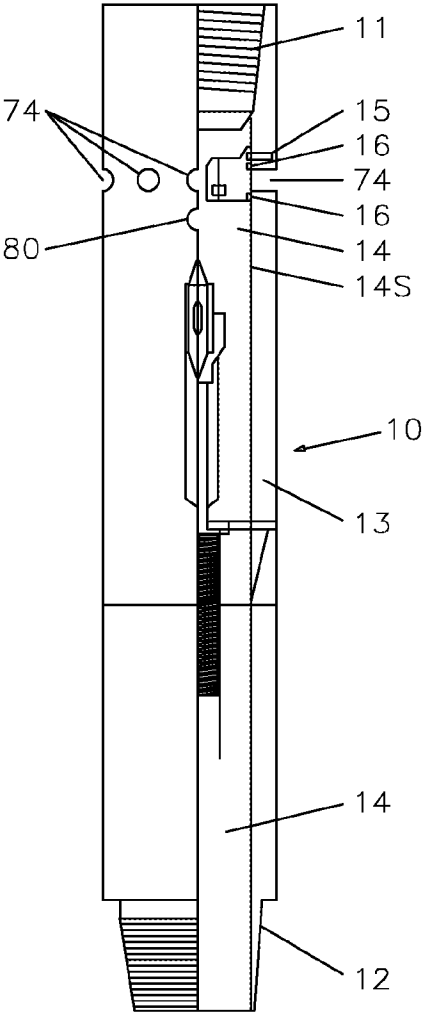
Figure 2A:
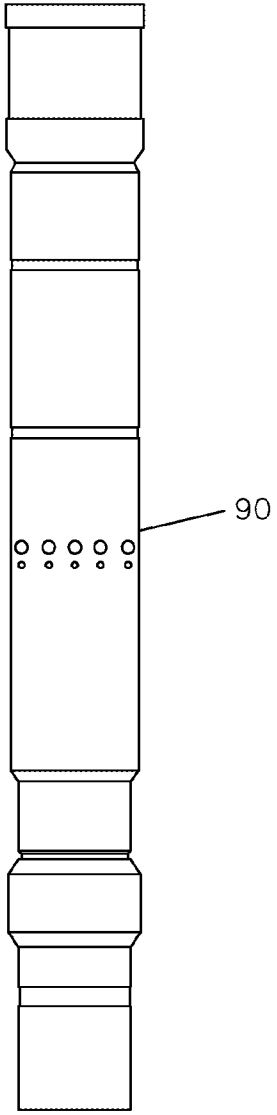
Figure 5:
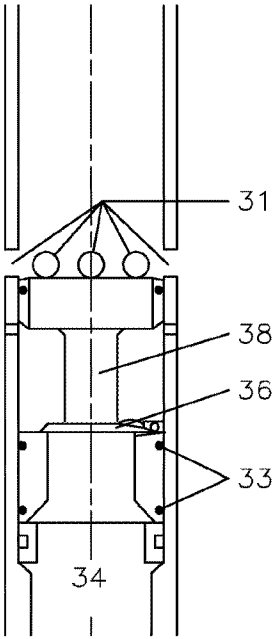
Figure 4B:
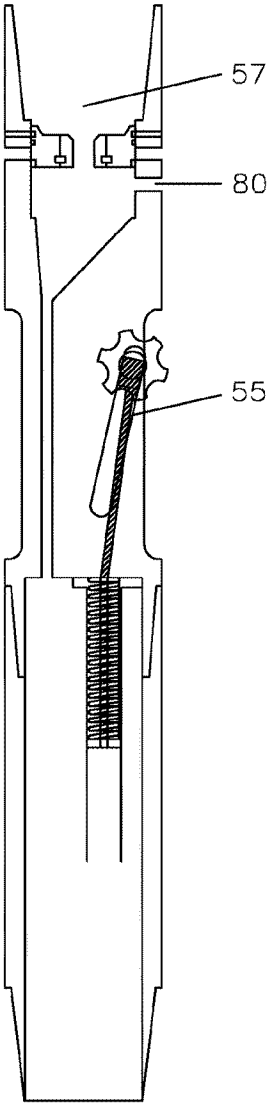
Figure 4A:
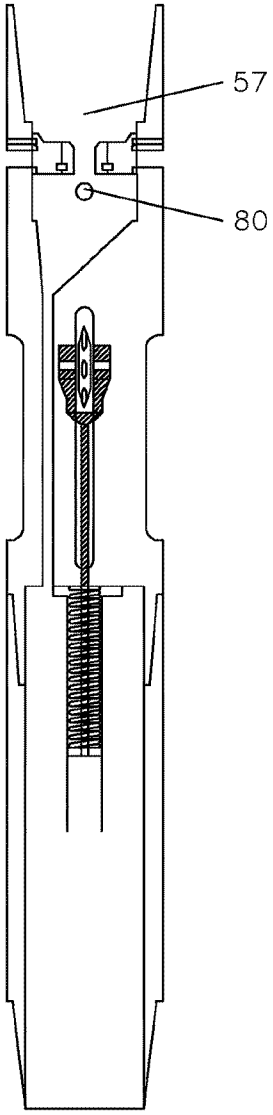
Figure 7B:
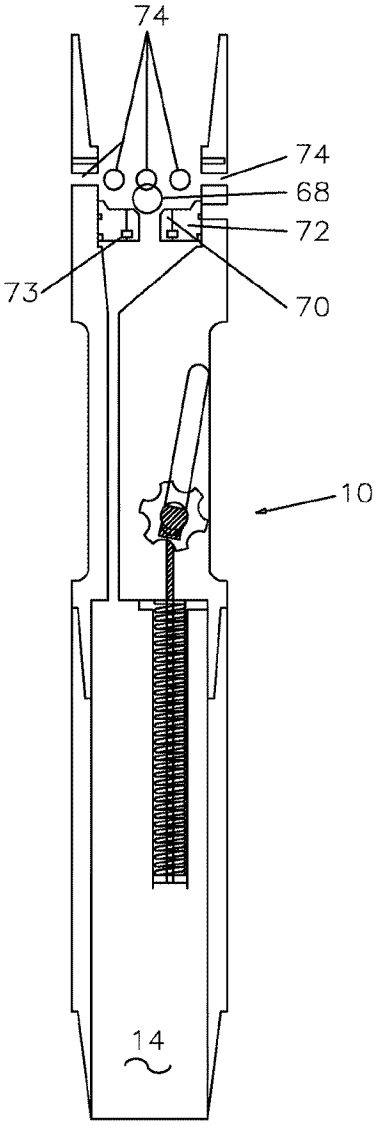
FIG. 7(*a*) is a cross-sectional view of the slotting and jetting tool of FIG. 6(*a*) but now shows the shear pins that hold the seat as having been sheared thus uncovering the 360 degrees jetting/washing ports and the slotting and jetting tool 10 is now in the configuration required for Stage 28 of the method.
Figure 7A:
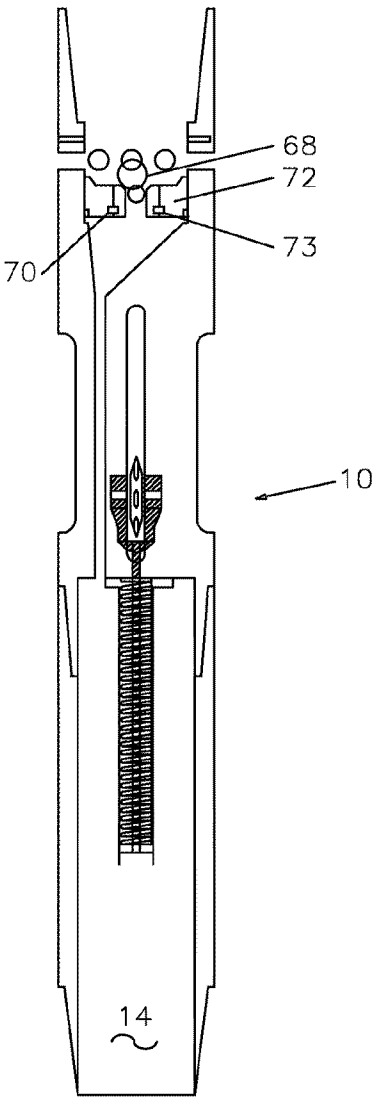
Figure 6B:
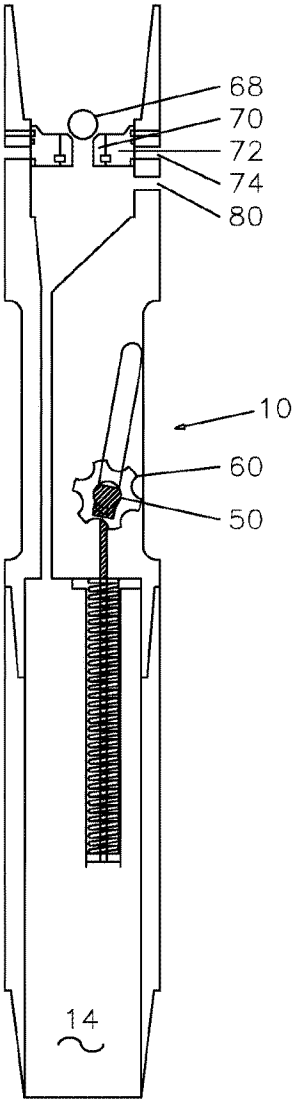
FIG. 6(*b*) is a cross-sectional view of the slotting and jetting tool of FIG. 6(*a*) but being shown from a different rotational cross-section (i.e. with a 90 degrees rotational offset around the longitudinal axis) from that of FIG. 6(*a*)
Figure 6A:
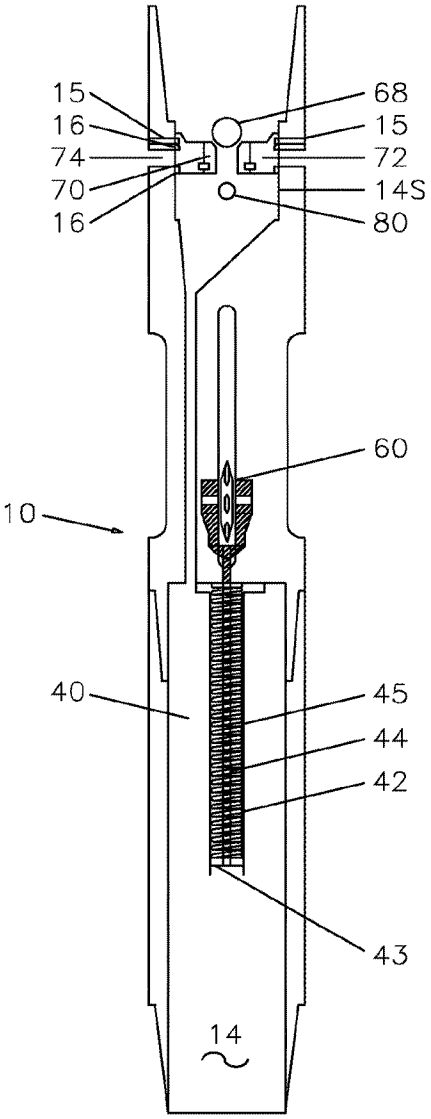
Figure 8A:
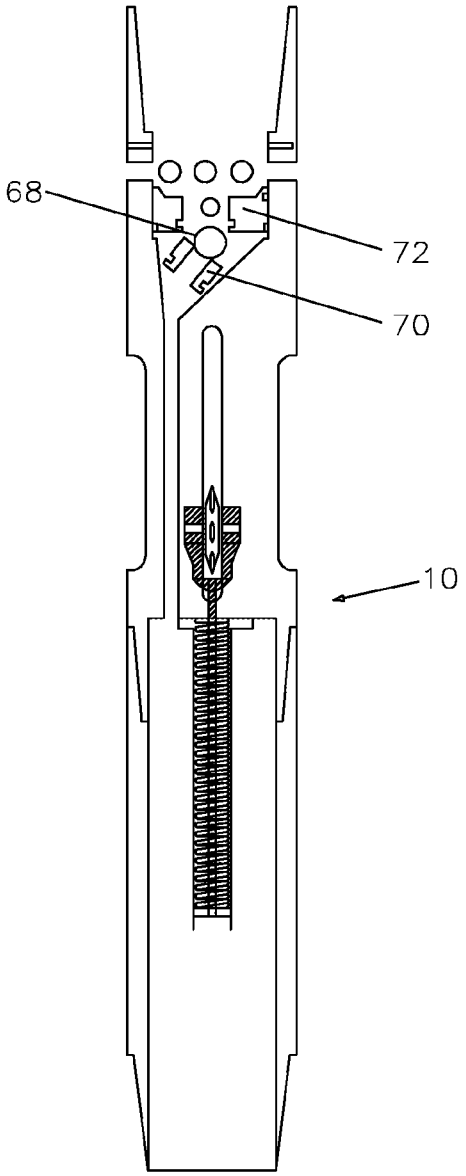
Figure 8B:
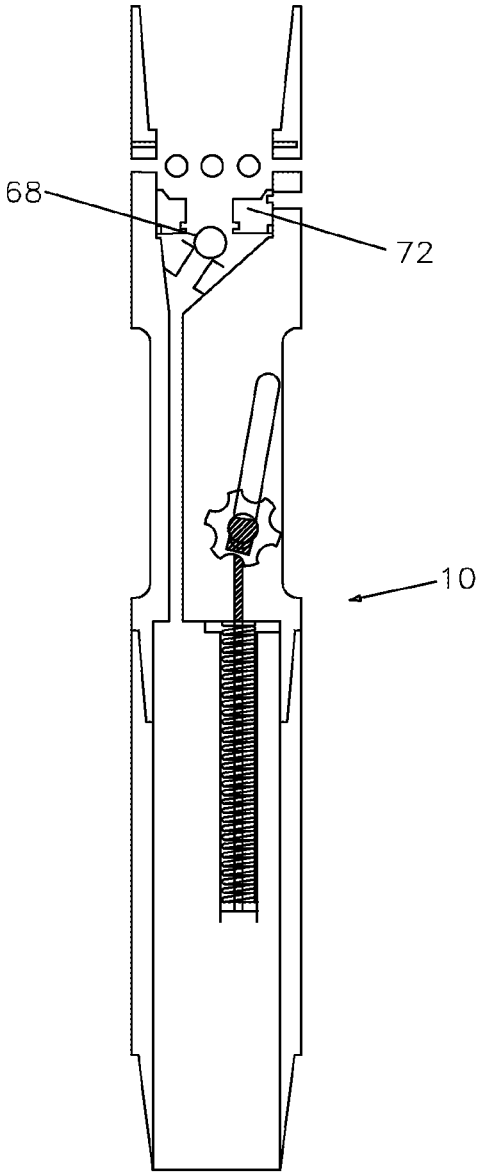
Figure 9:
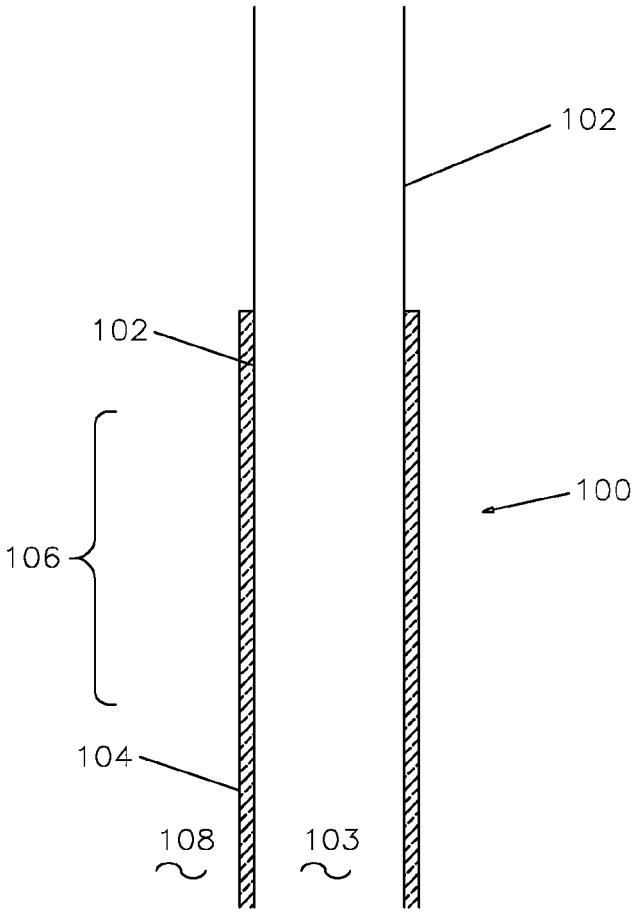
Figure 10:
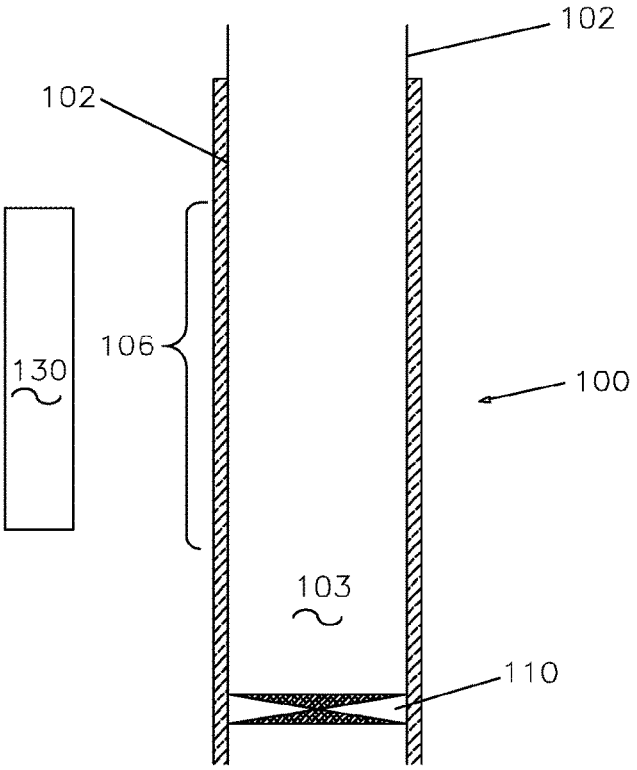
Figure 11:
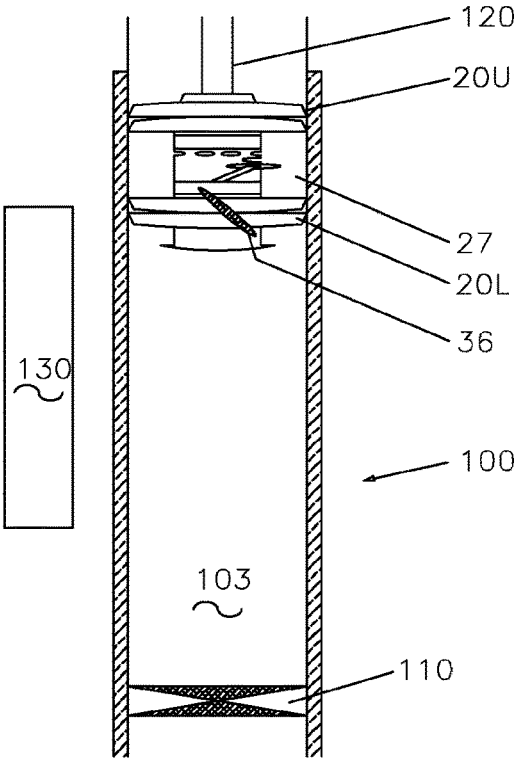
Figure 12:
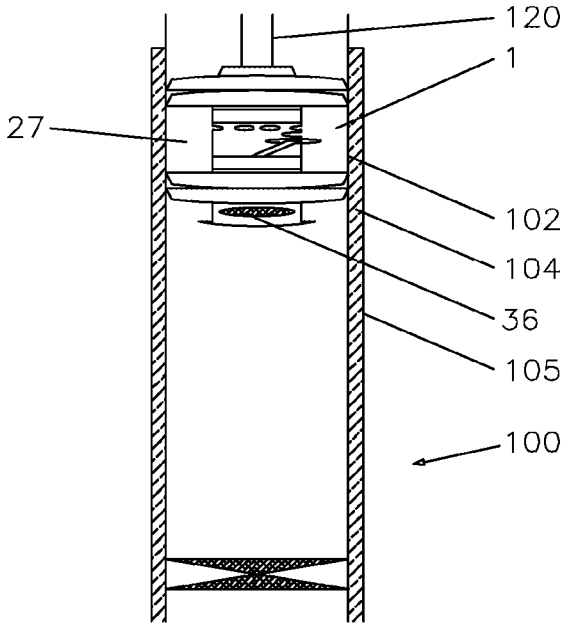
Figure 13:
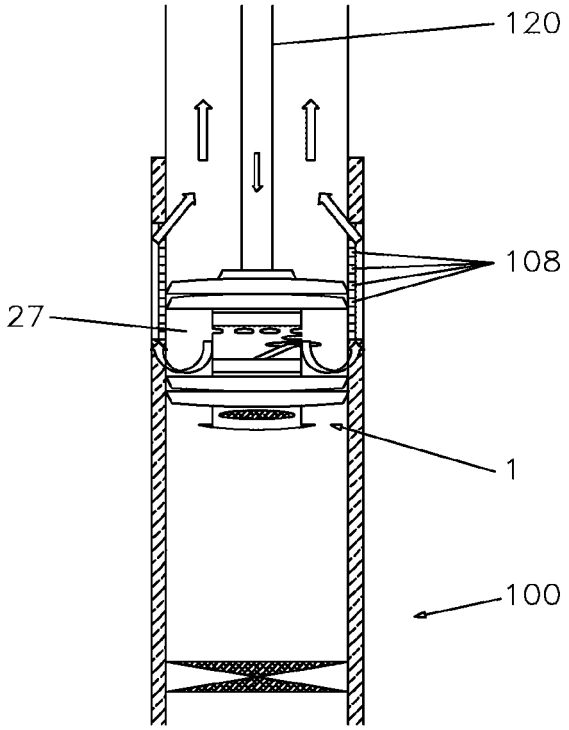
Figure 14:
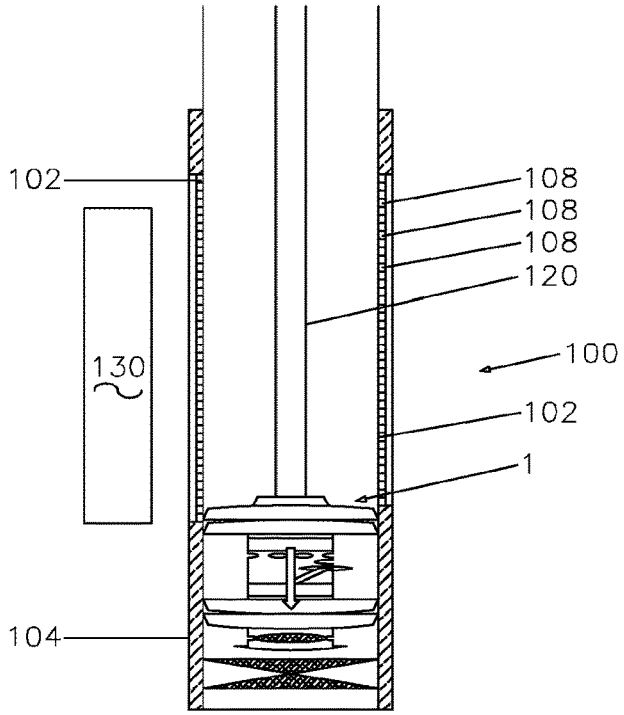
Figure 15:
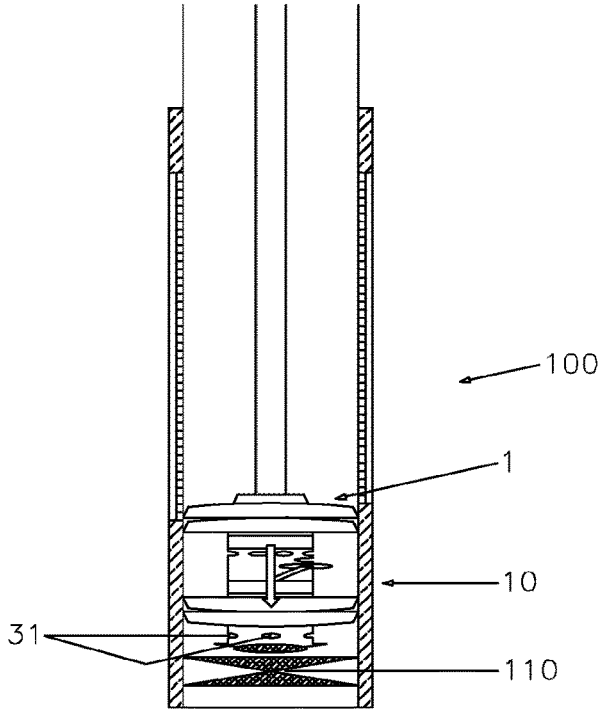
Figure 16:
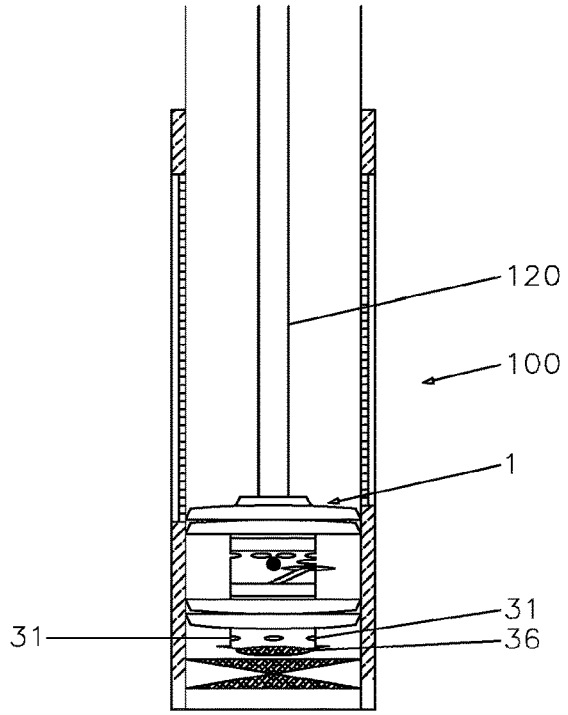
Figure 17:
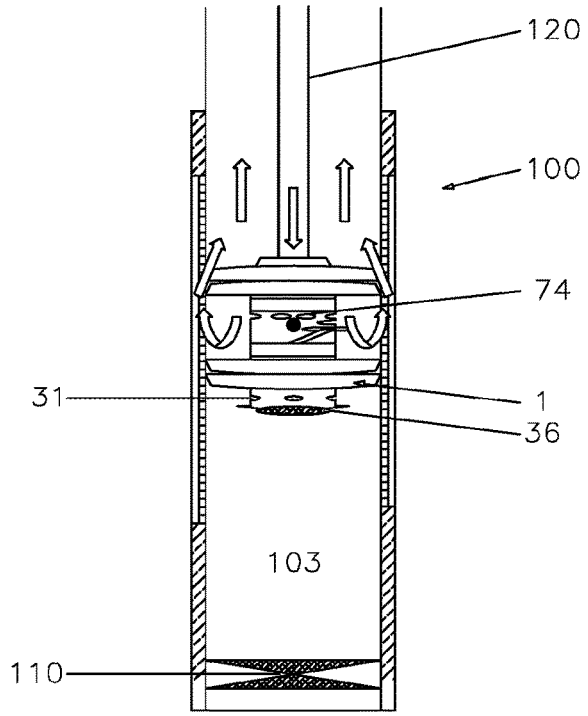
Figure 18:
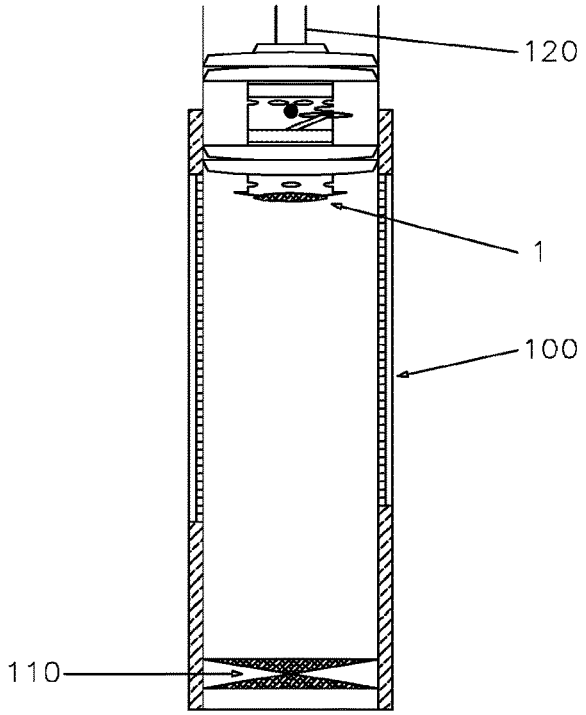
Figure 19:
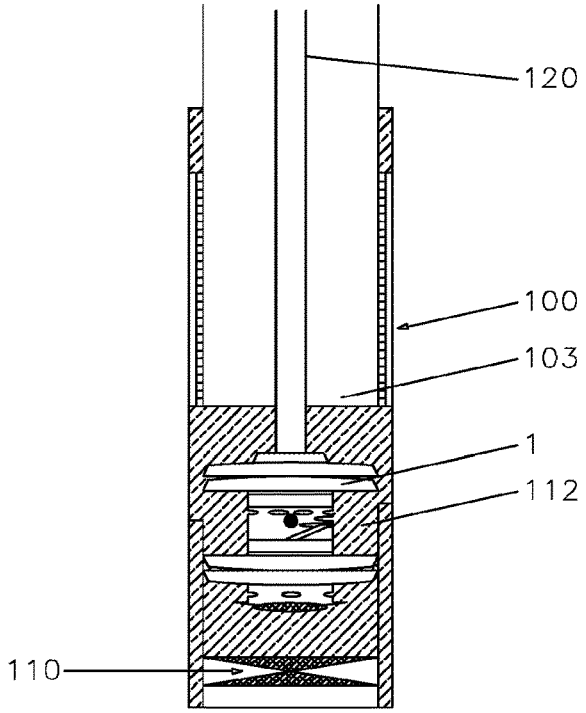
Figure 20:
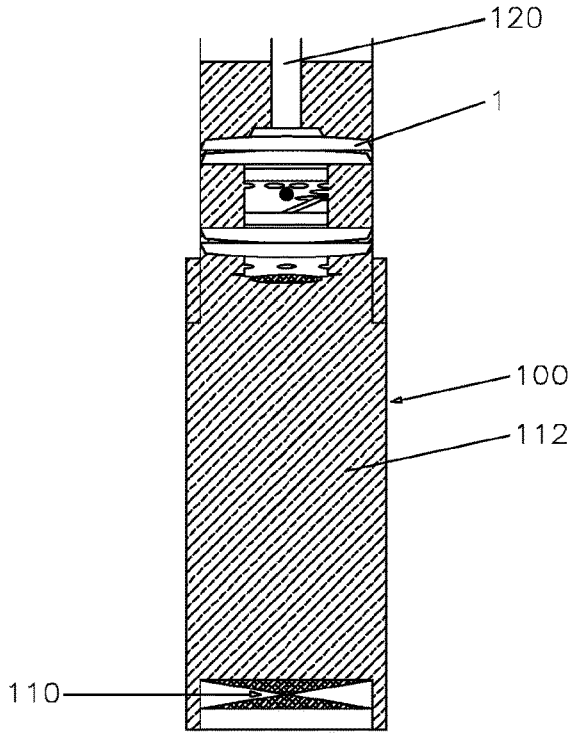
Figure 21:
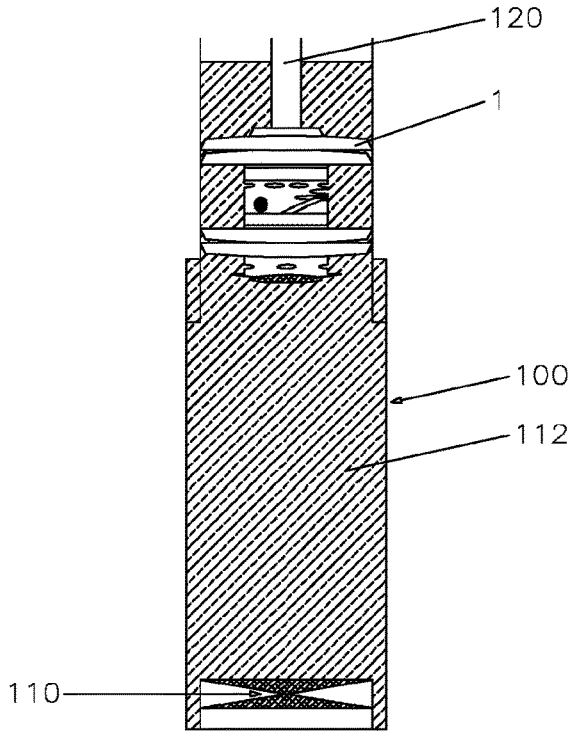
Figure 22:
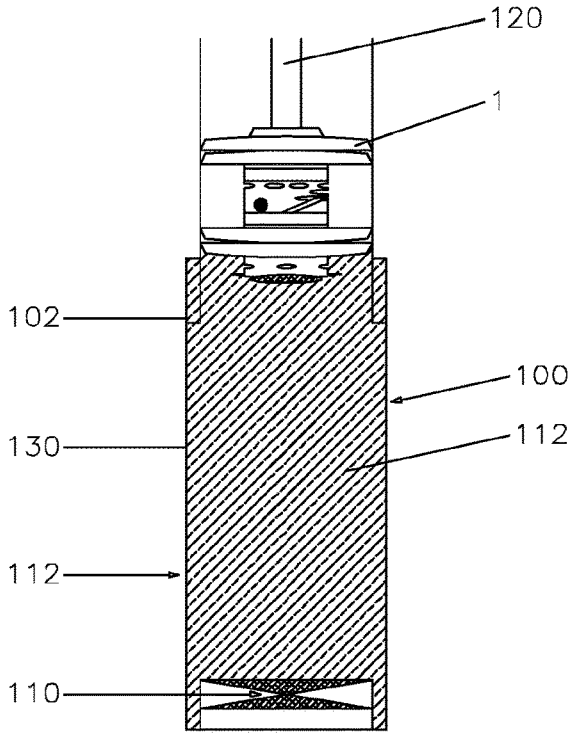
Figure 23:
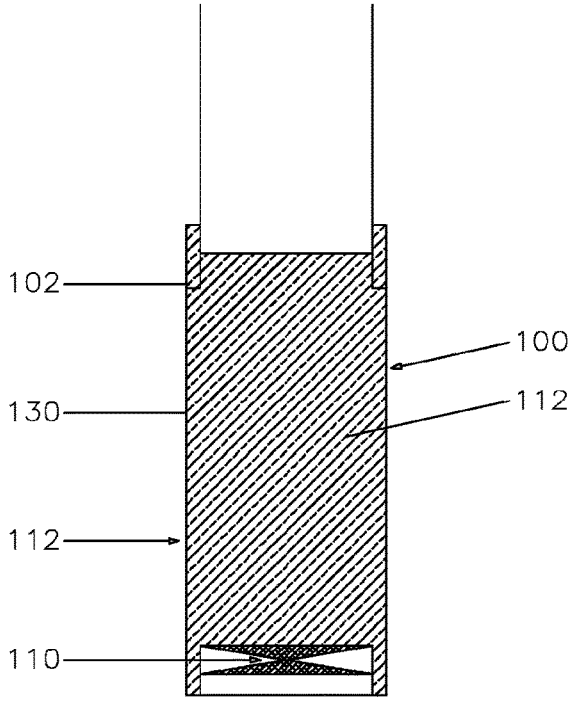
Figure 24A:
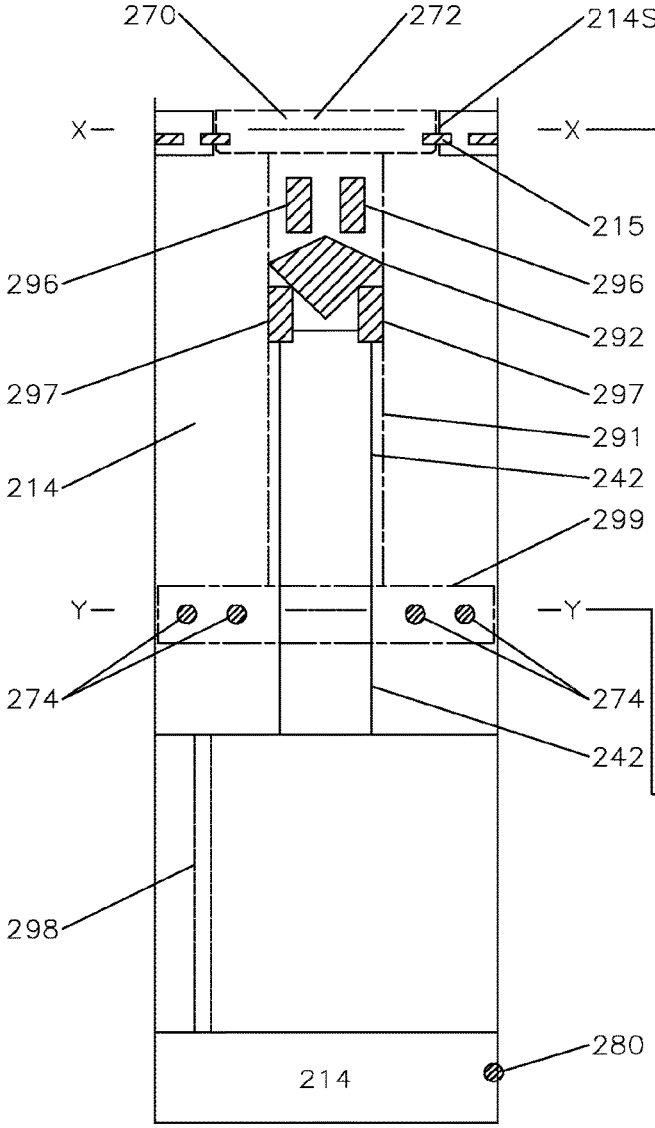
Figure 25:
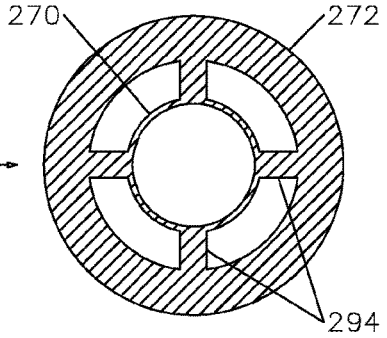
Figure 26:
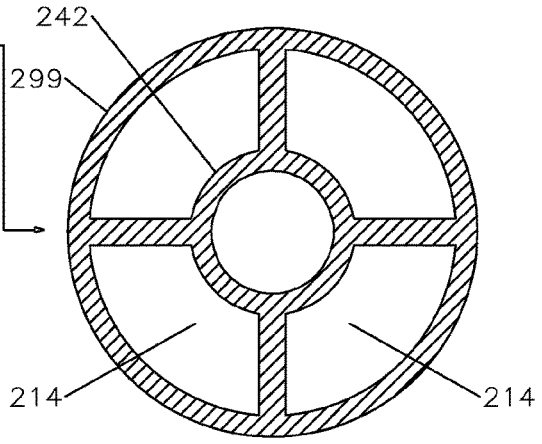
Figure 24B:
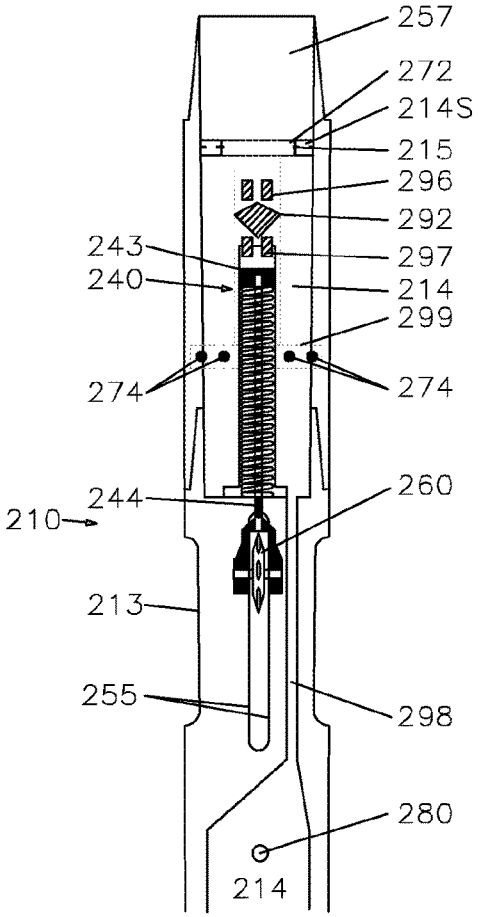
Figure 24C:
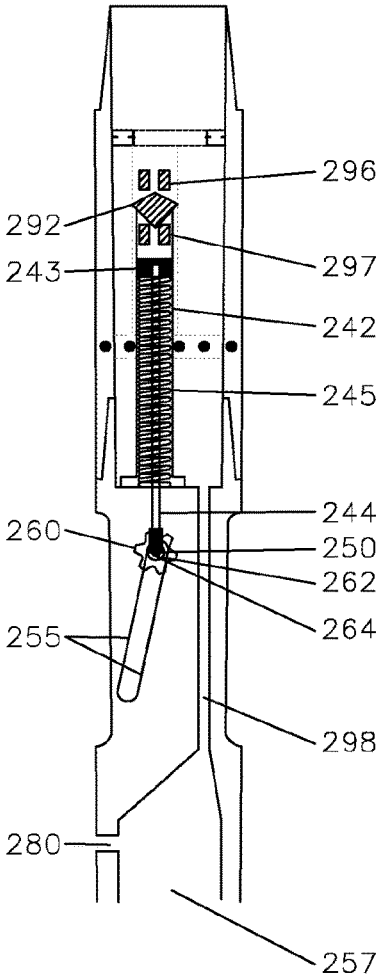
Figure 27A:
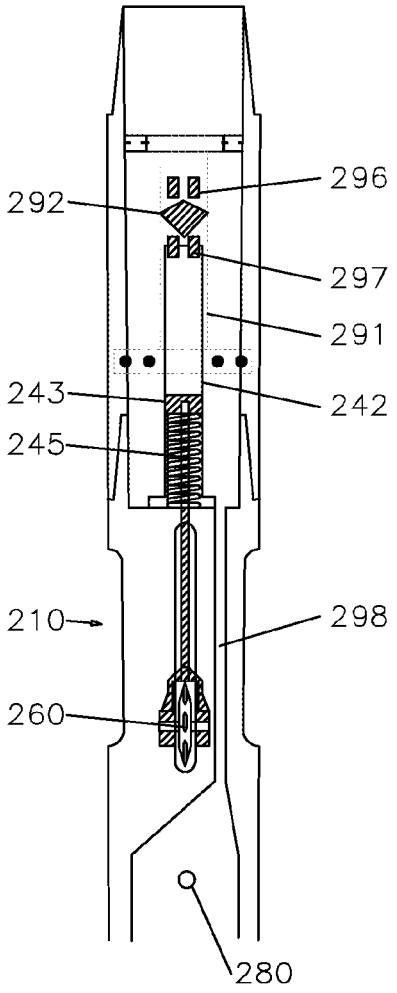
Figure 27B:
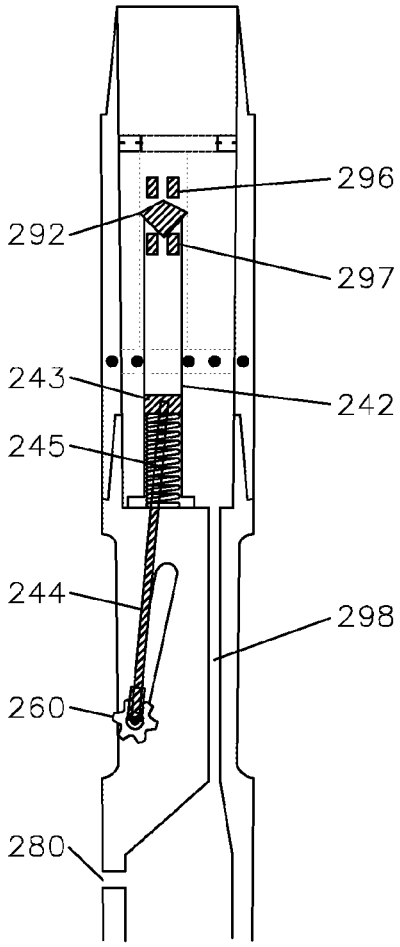
Figure 28:
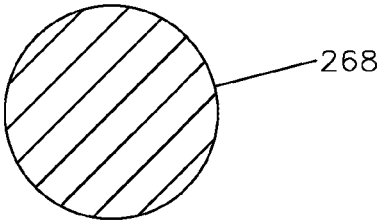
Figure 29A:
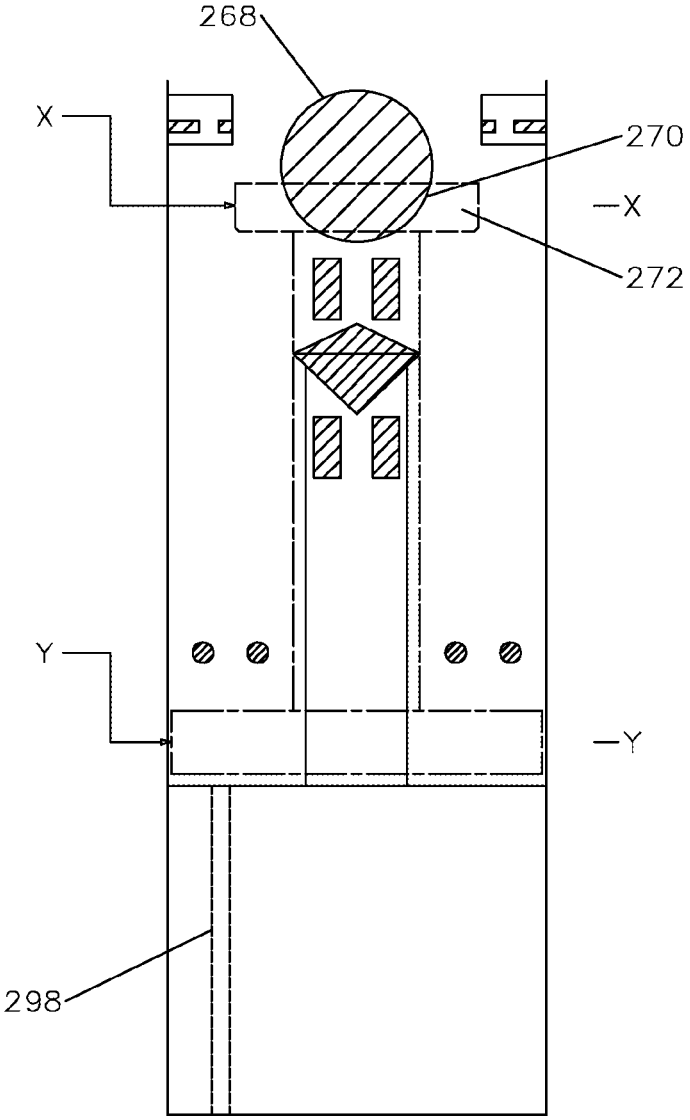
Figure 29B:
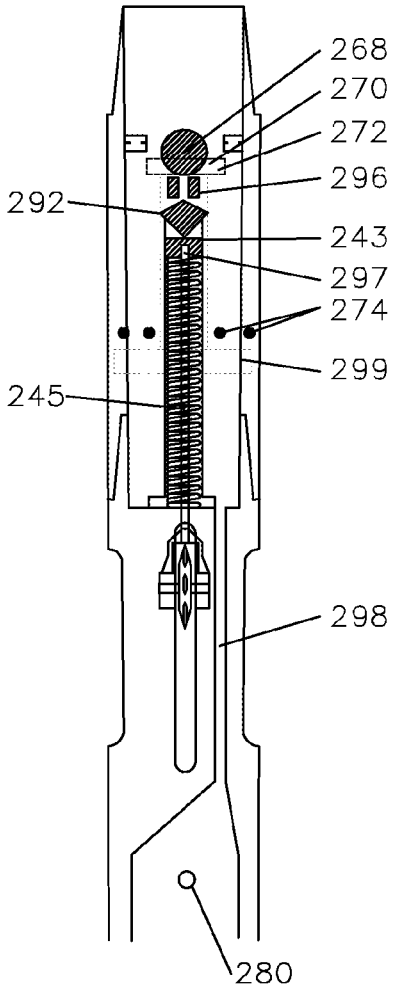
Figure 29C:
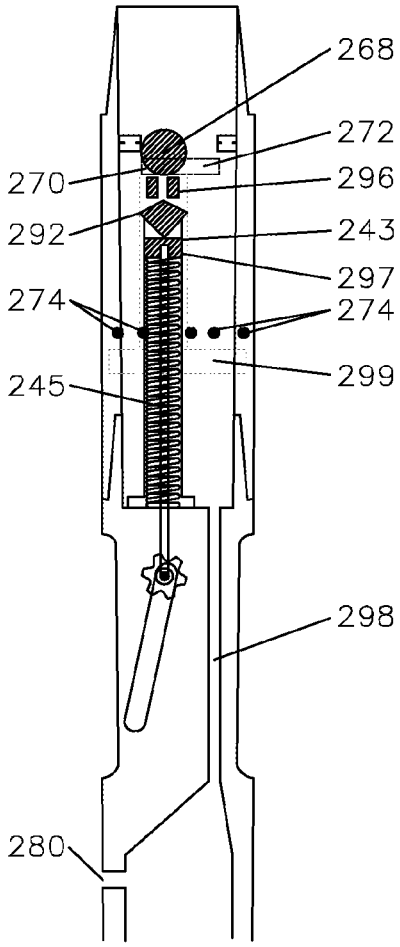

FIGS. 8 (*a*) and 8 (*b*) are cross-sectional views of the slotting and jetting tool of FIG. 7 (*a*) but is now shown with the further and final shear pins that hold the inner ball seat within the ball seat carrier as having sheared and so the ball seat and ball have moved through the ball seat carrier and circulation of fluid in liquid form through the slotting and jetting tool 10 throughbore has been opened and thus fluid flow therethrough is permitted and thus circulation of fluid in liquid form below the slotting and jetting tool 10 has been permitted, and the slotting and jetting tool is now in the configuration shown in FIG. 21 and is now in the configuration required for Stage 41 of the method during the isolation procedure;

FIG. 9 is a schematic side view of a wellbore that an operator requires to be plugged and abandoned and shows the start of the running and slotting procedure which will have the BHA of FIG. 1 run into it and will have the method of some or all of Stages 1 to 45 of the method that will be subsequently described in detail in accordance with the present invention performed upon it (Stages 1 to 23 correspond to the running and slotting procedure) and thus FIG. 9 shows the wellbore before the BHA of FIG. 1 is run into it; this FIG. 9 generally relates to Stages 1 and 2 of the method that will be subsequently described in detail;

FIG. 10 shows a subsequent Stage 3 of the method to be subsequently described in detail that will be performed on the wellbore to that of FIG. 9, where a bridge plug has been set at a lower end of the wellbore;

FIG. 11 shows a subsequent stage of the wellbore on from that shown in FIG. 10, where the BHA of FIG. 1 has been run into the wellbore approximately to the depth at which the casing of the wellbore requires to be slotted, where FIG. 11 largely corresponds to Stage 5 in the method to be detailed subsequently;

FIG. 12 shows a subsequent stage on from that of FIG. 11 where the BHA remains at depth and the work string has been pressured up such that the flapper valve provided within the inverted float (shear) sub has been moved from the open configuration shown in FIG. 2(*e*) to the closed configuration shown in FIG. 2(*f*) and the pressure built up within the throughbore of the work string activates the slotting blades/cutting wheel of the slotting and jetting tool to cut slots through the side wall of the casing—the BHA in the configuration shown in FIG. 12 corresponds to Stage 7 of the method that will be subsequently described and the slotting and jetting tool corresponds to the configuration shown in FIGS. 4(*a*) and 4(*b*);

FIG. 13 shows a subsequent stage on of operation of the BHA to that shown in FIG. 12, where the BHA in FIG. 13 is moved down the wellbore, typically by the operator lowering the work string and thus the BHA deeper into the wellbore, in order for the slotting blade/cutting wheel to puncture through the casing as it is moved down the wellbore and where cleaning/washing fluid has been pumped down the throughbore of the drill pipe string at pressure and jetted out of the single jetting nozzle whilst slotting has occurred—FIG. 13 broadly corresponds to Stage 8 of the method that will be detailed subsequently;

FIG. 14 shows a subsequent stage of operation of the BHA to that of FIG. 13, and shows the final Stage of the Running and Slotting procedure, where the BHA of FIG. 1 has been moved down (typically by the operator lowering the work string and thus the BHA deeper into the wellbore,) and then back up (typically by the operator raising or lifting the work string and thus the BHA upwards towards the surface within the wellbore), and then down the casing (again typically by the operator lowering the work string and thus the BHA deeper into the wellbore) in order to fully slot the casing/liner tubing as required whilst jetting through the single jetting nozzle at the same time as slotting and thus several passes have occurred by repeating Stages 12 to 21 of the method that will be subsequently described in detail and, once the slotting has been completed, the BHA is moved to the position shown in FIG. 14 which is an area where the test cups are located in a non-slotted area of the casing and the BHA is now at Stage 23 of the method that will be subsequently described in detail;

FIG. 15 is a subsequent stage of operation of the BHA on from that shown in FIG. 14, and shows the first Stage of a Final Jetting procedure, where the pressure of fluid within the throughbore of the drill string has been increased by the operator at surface such that a (first) set of shear pins provided in the inverted float (shear) sub have sheared, thus opening jetting/circulation ports in the side wall of the inverted float (shear) sub in order to provide circulation of fluid from the throughbore of the drill pipe string at a position in the BHA which is below the slotting and jetting tool and, in so doing, the flapper valve has moved downwards below the location of the circulation holes such that the flapper valve is now in the position shown in FIG. 5 and the BHA is now at Stage 26 of the final jetting procedure of the method as will subsequently be described;

FIG. 16 is a subsequent stage of the BHA on from that shown in FIG. 15, where a drop ball has been dropped at surface through the throughbore of the drill string and has landed on a ball seat provided within the throughbore of the slotting and jetting tool and fluid in the throughbore located above the drop ball has been pressured up by the operator at surface in order to shear a (second) set of shear pins that are provided in the slotting and jetting tool such that the (second) set of shear pins have sheared and the ball seat carrier has moved downwards within the slotting and jetting tool such that a set of 360 degrees jetting nozzles (which are formed through the side wall of the slotting and jetting tool at a position above the single jetting nozzle) have been uncovered such that the slotting and jetting tool has been transformed from the configuration shown in FIG. 6(*a*) to the configuration shown in FIG. 7(*a*) and the BHA is now at Stage 28 of the method which will be detailed subsequently;

FIG. 17 shows a subsequent stage of the operation of the BHA within the wellbore on from that shown in FIG. 16, where the BHA is picked up by picking up the string at surface and cleaning/washing fluid is pumped down the throughbore of the drill string and is jetted out of the 360 degrees nozzles of the slotting and jetting tool in order to clean the annulus behind the slotted casing—the BHA is now between method steps 29 to 31 of the method as will be subsequently described;

FIG. 18 shows a subsequent stage of operation of the BHA on from that shown in FIG. 17, and shows the final Stages of the final jetting procedure (albeit there may be several passes thereof), where the annulus behind the casing has been cleaned and the BHA has been moved upwards such that the pair of cups can be tested in a non-slotted section of the casing and the BHA is now between Stages 32-34 of the method as will be described subsequently;

FIG. 19 shows a subsequent stage of operation of the BHA on from that shown in FIG. 18 and shows the start of the isolation procedure where the BHA has been run further downhole (typically by the operator lowering the work string and thus the BHA deeper into the wellbore) and the operator has started to pump isolation material (such as cement or other suitable material) down the throughbore of the drill pipe string such that the cement or the like jets out of the (now uncovered) 360 degree jetting nozzles formed through the side wall of the slotting and jetting tool and the BHA has been submerged in isolation material such as cement—the BHA is now at Stage 35 of the method as will be detailed subsequently;

FIG. 20 shows a subsequent stage of operation of the BHA to that shown in FIG. 19, where the BHA has been pulled upwards (i.e. in the direction heading out of the hole) to above the upper end of the slot jet area 130 (i.e. just above the theoretical top of the newly pumped in isolation material (cement or similar)) without the operator rotating the drill pipe and where the operation is now at Stage 40 of the method as will be described subsequently in detail;

FIG. 21 shows a subsequent stage of operation of the BHA on from that shown in FIG. 20, where the operator has pressured up the isolation material such as cement in the throughbore of the drill pipe string and that has caused a (third) set of shear pins provided within the slotting and jetting tool to shear which has caused the ball seat to be separated from the ball seat carrier and thus has allowed the ball and ball seat to drop and thus has allowed circulation of isolation material/cement to occur through the throughbore at the bottom of the slotting and jetting tool and out through the jetting holes provided in the inverted float (shear) sub and thus the BHA is now at Stage 41 of the isolation procedure of the method as will be described in detail subsequently;

FIG. 22 shows the next stage of operation of the BHA on from that shown in FIG. 21, where the operator circulates the well clean at the maximum loss free rate with cleaning/washing fluid pumped from the surface by the operator through the throughbore of the drill string and the BHA is now shown as being at Stage 42 of the isolation procedure of the method as will be described in detail subsequently;

FIG. 23 shows the wellbore at the end of the plug and abandonment operation performed as shown in FIGS. 9 to 22 in accordance with the present invention, where the isolation material/cement plug has been formed within the wellbore such that the wellbore is now abandoned having been plugged by the new isolation material and the BHA and drill pipe string has been pulled out of the hole with the operator laying out or laying down the drill pipe and the BHA including the slotting and jetting tool, and the operation is now at step 45 of the isolation procedure of the method as will be described in detail subsequently;

FIG. 24(*a*) is a schematic cross-sectional side view of a second (alternative) embodiment of a slotting and jetting tool in accordance with the present invention and which can be incorporated in the BHA of FIG. 1 as an alternative to the first embodiment of the slotting and jetting tool shown in FIG. 2 (as required by the operator) and where the slotting and jetting tool of FIG. 24 is referred to as an inverted slotting and jetting tool (compared with that of FIG. 2) and which is shown in a running in hole (RIH) configuration and therefore is shown as being in a prior to actuation configuration in that its activation piston has not been pressured up (i.e. the activation piston is not experiencing pressure because the liquid fluid in the throughbore of the slotting and jetting tool (whilst it is being run into the hole) is not pressured up);

FIG. 24(*b*) is a cross-sectional side view of the inverted embodiment of the slotting and jetting tool of FIG. 24(*a*) also being shown on same rotational cross section and also being shown in the running in hole (RIH) configuration and therefore is shown as being in a prior to actuation configuration;

FIG. 24(*c*) is a cross-sectional view of the inverted embodiment of the slotting and jetting tool of FIG. 24(*b*) but being shown from a different rotational cross-section (i.e. with a 90 degrees rotational offset around the longitudinal axis) from that of FIG. 24(*b*) but which is also shown in the RIH configuration (i.e. the activation piston is not pressured up);

FIG. 25 is a cross sectional plan view through section X-X of a drop ball seat of the slotting and jetting tool of FIG. 24(*a*) showing fluid bypass channels being provided and which extend downwards below the ball seat;

FIG. 26 is a cross sectional plan view through section Y-Y of a washing ports sleeve cover of the slotting and jetting tool of FIG. 24(*a*) showing fluid bypass channels being provided therethrough and which extend downwards below the washing ports sleeve cover;

FIG. 27(*a*) is a cross-sectional side view of the inverted (second and alternative) embodiment of the slotting and jetting tool of FIGS. 24(*a*) and 24(*b*) and in the same rotational cross sectional view as that of FIG. 24(*b*) but the inverted slotting and jetting tool is now shown in the configuration where the activation piston is experiencing fluid pressure being applied to it (due to the fluid pressure in the throughbore of the work string having been pressured up at surface and which against the uppermost surface of the piston) and therefore where the inverted slotting tool can be moved upwards within the wellbore by the operator pulling up on the work string at the surface thereof in order to form slots in the inner surface and thus through the sidewall of the wellbore (such as the casing);

FIG. 27(*b*) is a cross-sectional side view of the inverted slotting and jetting tool of FIG. 27(*a*) but being shown from a different rotational cross-section (i.e. with a 90 degrees rotational offset around the longitudinal axis) from that of FIG. 27(*a*), and therefore the inverted slotting and jetting tool of FIG. 27(*b*) is in the same pressured up configuration as that of FIG. 27(*a*);

FIG. 28 is a side view of a drop ball for use with the inverted slotting and jetting tool of FIG. 24(*a*) and which can be dropped down through the throughbore of the work string at the surface thereof by the operator when desired by the operator;

FIG. 29(*a*) is a schematic cross-sectional side view of the inverted embodiment of the slotting and jetting tool of FIG. 24(*a*) and which is now shown in a washing configuration in which the ball seat having been sheared out and the slotting blade piston having been isolated and with fluid communication having been opened up through the inverted slotting and jetting tool in order to provide fluid communication from above and through to below the inverted slotting and jetting tool and which has also had its 360 degrees washing nozzles opened in order to permit washing of the inner surface of the wellbore (e.g. the casing) and in particular the annulus outside of the casing;

FIG. 29(*b*) is a cross-sectional side view of the inverted embodiment of the slotting and jetting tool of FIG. 29(*a*) also being shown on same rotational cross section and also being shown in the same washing configuration as that of FIG. 29(*a*); and FIG. 29(*c*) is a cross-sectional view of the inverted embodiment of the slotting and jetting tool of FIG. 24(*b*) but being shown from a different rotational cross-section (i.e. with a 90 degrees rotational offset around the longitudinal axis) from that of FIG. 29(*b*) but which is also shown in the same washing configuration as that of FIGS. 29*a*) and (*b*).

DETAILED DESCRIPTION OF PREFERRED EMBODIMENTS OF PRESENT INVENTION

BHA 1

FIG. 1 shows an embodiment of a Bottom Hole Assembly 1 (BHA 1) incorporating a first embodiment of a slotting and jetting tool 10 in accordance with the present invention. The BHA 1 is to be run into a wellbore 100 to be plugged and abandoned (see FIG. 9), the wellbore 100 having for example having produced all of the viable hydrocarbons possible and therefore has come to the end of its productive life. The BHA 1 will typically be run into the wellbore 100 at a suitable location in a work string which will typically be made up of one or more tubulars such as either coiled tubing (not shown) or a string made up of a plurality of drill pipe stands which are screwed and unscrewed together at surface to make up a work string such as a drill string 120.

The BHA 1 comprises three main tools secured together:—

I. upper jetting cups 20U mounted on upper jetting cup tool 22;

II. slotting and jetting tool 10; and

III. lower jetting cups 20L mounted on lower jetting cup tool 24

The BHA 1 as shown in FIG. 1 comprises at its upper most end an upper pair of jetting cups 20U, which are typically formed of relatively durable rubber material or the like and which are mounted longitudinally spaced apart on an upper jetting cup tool 22 which comprises at its upper most end a suitably threaded pin connection 23 for connection with a suitably threaded box connection (not shown) provided at the point of inclusion in the drill pipe string 120. The upper jetting cup tool 22 further comprises a box connection 21 (as shown in FIG. 2(*c*)) provided at its in use lower most end and which in use is securely threadedly connected to box connection 11 provided at the upper most end of the slotting and jetting tool via a suitable sub-connector or cross-over sub (not shown) having suitable pin connections provided at both ends. Alternatively, and more preferably, the box connection 21 of the upper jetting cup tool 22 could be modified to instead be a pin connection (not shown) which would allow direct secure connection to the box connection 11 of the slotting and jetting tool 10. The cups 20 maybe any suitable conventional cups, one example of which is manufactured by RubberAtkins Limited of Aberdeen UK but other suppliers of cups are available such as those offered under the Guiberson™ brand by Oil States Industries of Arlington, Texas, USA.

It should be noted that a bypass channel or other bypass mechanism is provided (but is not shown in the FIGS.) in either the cups 20 or in each of the upper and lower cup tools 22, 24 in order to permit fluid to bypass the cups 20 (either around the outer edge of the cups 20 or through the cups 20 or around the inner surface of the cups 20) particularly when the BHA 1 is being run into or pulled from the wellbore 100 in order to avoid swab surging or hydraulic locking within the annulus (between the outer surface of the drill string 120 and the inner surface of the casing 102) particularly when the outer diameter of the cups substantially matches the inner diameter of the wellbore 100 (e.g. the casing 102). It should also be noted that the bypass channel will be blocked or obturated when pressure is applied between the cups 20 by the operator from surface when either circulating/jetting through the single jetting port 80 and/or circulating/jetting through the second set of 360 degree jetting ports/circulation ports 74.

It should be noted that each of the upper 22 and lower 24 jetting cup tool comprises two cups 20 but only one cup 20 is required for each of the upper 22 and lower 24 jetting cup tools but two cups 20 per tool 22, 24 is preferred in order to provide redundancy in case one cup 20 per pair were to fail.

The cups 20 are generally arranged such that they will in use provide a seal in the annulus 27 between the outer surface of the drill string 120 and the inner surface of the casing 120 and in particular to prevent the washing/cleaning fluid that is jetted through either the single jetting nozzle 80 or the second set of 360 degree jetting nozzles/circulation ports 74 from:— passing further up the said annulus 27 than the upper cups 20U (unless the washing fluid can bypass the upper cups by passing through the slots 108 first); and passing further down the said annulus 27 than the lower cups 20U (unless the washing fluid can bypass the upper cups by passing through the slots 108 first).

The cups are arranged such that the higher the pressure of fluid acting upon the inner facing faces of the cups 20, the higher the sealing force acting upon the cups 20 against the casing 102.

A pin connection 12 is provided at the lower end of the slotting and jetting tool 10 and in use of the BHA 1, the pin connection 12 is securely coupled to the box connection 25 provided at the upper end of the lower jetting cup tool 24. The lower jetting cup tool 24 comprises a pair of longitudinally spaced apart pair of jetting cups 20L provided around the outer circumference thereof and which again are formed of a suitable resilient material such as rubber or the like.

The lower end of the lower jetting cup tool 24 is provided with a pin connection for secure coupling to the upper end of the inverted float (shear) sub 30.

It should be noted however that a swivel tool 90 is incorporated toward the lower end of the drill string 120 just above the BHA 1 in order to allow the drill string 120 to rotate with respect to the BHA 1 when the operator requires that rotation (i.e. the operator can activate the swivel tool 90 to rotationally lock or rotationally decouple the BHA 1 from the drill string 120 as required in order to permit the BHA 1 to be stationary in the wellbore 100 whilst the drill string 120 is rotating in order to aid stirring up/circulation of fluid in the wellbore 100) as will be described subsequently. A suitable swivel 90 is shown in FIG. 2(*a*) and a suitable example of such a swivel is a Swivel Master™ offered by Rubicon Oilfield of Aberdeen, UK but other suitable swivels could also be used such as that offered by R&D Solutions of Perth, Western Australia.

First Embodiment of Slotting and Jetting Tool 10

The slotting and jetting tool 10 comprises an outer body or mandrel 13 having a throughbore 14 through which fluid can be pumped from the surface of the wellbore through the drill string throughbore (assuming that the throughbore 14 is not impeded by a drop ball 68 as will be subsequently described).

Figure 3B:
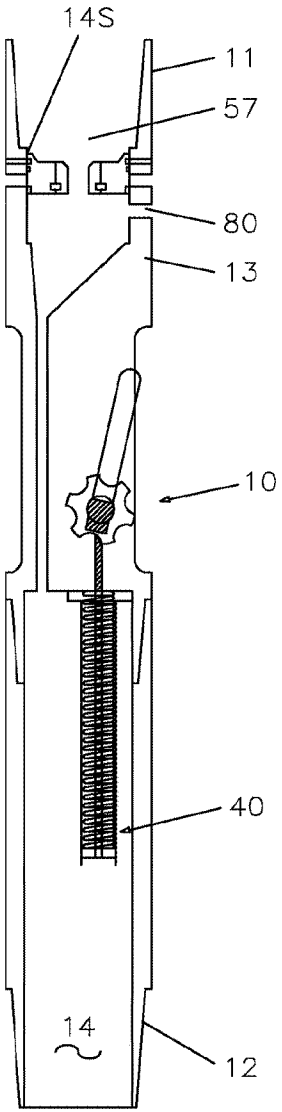
Figure 3A:
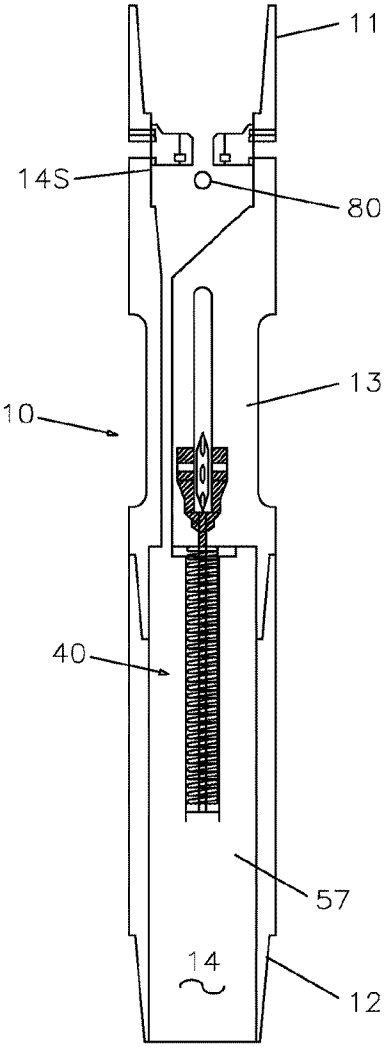
Figure 2F:
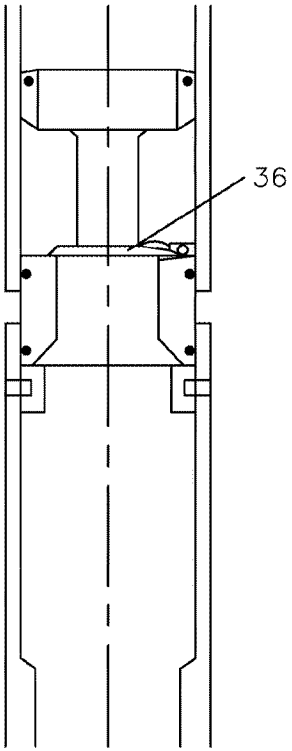
Figure 2E:
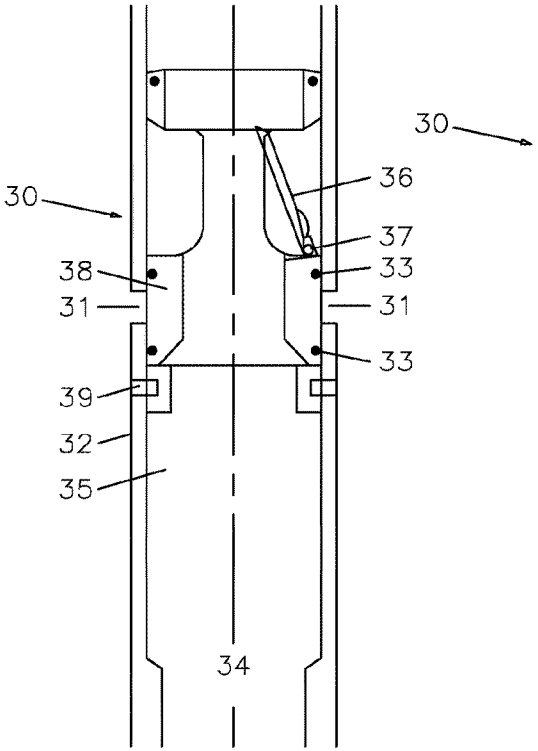
Figure 4E:
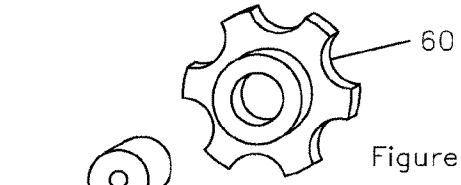
Figure 4D:
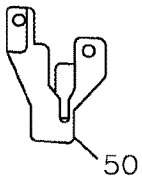
Figure 4C:
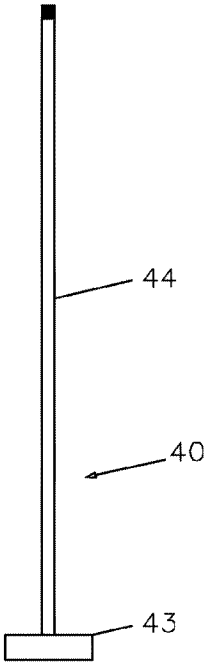

A ball seat carrier 72 is (at least initially) secured within the throughbore 14 of the mandrel 13 to the inner surface 14S thereof by a first set 15 of shear pins such that whilst the first set of shear pins 15 remain intact, the ball seat carrier 72 remains in position as shown in FIG. 3(*a*) and therefore sealingly obturates a (second) set of (a plurality of) jetting nozzles/circulation ports 74 which are equi-spaced around the circumference of the mandrel 13 formed through the side wall thereof thus providing a 360 degree coverage of fluid jetting function when they have been uncovered as will be described subsequently. However, whilst the ball seat carrier 72 is shear pinned in place by the first set of shear pins 15, no fluid can pass from the throughbore 14 through the (second) plurality or set of jetting nozzles/circulation ports 74 due to the presence of O-ring seals located and acting in between the outer surface of the ball seat carrier 72 and the inner surface 14S of the mandrel 13 at a location above and below the (second) set of jetting nozzles/circulation ports 74.

However, there is further provided a single jetting nozzle 80 formed through the side wall of the mandrel 13 at a position just below the ball seat carrier 72 and which is preferably circumferentially aligned (aligned on the same longitudinal axis or plane) with a slotting blade or cutting wheel 60 and which in use will provide a jetting action to jet through the slots that are punctured through the casing 102 along the length or area of casing to be slotted 130 by the cutting wheel 60 in order to jet or wash away the old cement or formation or indeed unwanted gas or other fluid) 104 in the annulus in a slot jet area 106 between the outer surface of the casing 102 and the inner surface of the borehole 105. Further details of the use of the single jetting nozzle 80 will be described subsequently.

It should be noted that the diameter of the single jetting nozzle 80 and also the diameter of the first set of jetting nozzles/circulation ports 31 and also the diameter of the second set of jetting nozzles/circulation ports 74 can be varied as required to permit greater or lesser flow therethrough. In addition, it should be understood that the single jetting nozzle 80 contains a jet which permits fluid to pass therethrough:— a) in a circulation mode up to a certain pre-determined pressure (in order to move the fluid downhole in order to e.g. lift the debris out of the wellbore 100; and b) once the required pre-determined pressure has been reached (which as will be described subsequently, particularly during Stage 8) could be in the region of 1750 PSI in this example, the said jetting nozzle 80 will jet the fluid at a disruptive forceful rate sufficient to dislodge and/or disturb the old cement 104 or formation or other material 104 such as unwanted gas or other fluid 104 in the annulus in the slot jet area 106 between the outer surface of the casing 102 and the inner surface of the borehole 105, and ultimately circulate such material 104 up to the surface of the wellbore 100 for disposal.

An activation mechanism in the form of an activation piston 40 is generally located in the throughbore 14 of the mandrel 13, where the activation piston 40 comprises a downwardly projecting cylinder 42 having a piston head 43 located within the cylinder 42 at the lower most end thereof, where the piston head 43 is provided at the lower end of a piston rod 44 and where a spring 45 (which may be a coiled spring 45 or leaf washers or any other suitable spring) acts between the mandrel 13 and the upper face of the piston head 43 and wherein the spring acts to bias the piston head and thus the piston rod into the position/configuration of the slotting and jetting tool 10 shown in FIG. 3(*a*). The lower face of the piston head 43 is in use in fluid contact with the fluid located in the throughbore 14 and the outer circumferential surface of the piston head 43 is sealed to the inner surface of the cylinder 42 by a suitable seal such as an O-ring seal or the like.

The upper end of the piston rod 44 is pivotally coupled to a wheel mount 50 upon which is mounted a slotting blade in the form of a cutting wheel 60 by means of a wheel hub 62 and a wheel axle 64. The wheel hub 62 and wheel axle 64 can furthermore lie within an axially extending and angled slotted ramp 55. The slotted ramp 55 is angled such that it angles (preferably linearly) outwardly from the longitudinal axis or centre line 57 of the slotting and jetting tool 10 as it axially extends upwards. Accordingly, the lower end of the slotted ramp 55 is closer to the centre line 57 of the slotting and jetting tool 10 than the upper end of the slotted ramp 55. The wheel axle 64 is located on its rotational axis which is perpendicular to the radius of the slotting and jetting tool 10 extending from the centre line 57. Accordingly, the activation piston 40 is arranged such that an increase in fluid pressure within the throughbore 14 acts upon the lower face of the piston head 43 and will therefore force the piston head 43 and thus the piston rod 44, wheel mount 50 and thus the wheel axle 64, wheel hub 62 and most importantly the cutting wheel 60 in both an axially upwards direction and also a radially outwards direction such that the cutting wheel 60 will move from the stored/inactive/running in hole configuration shown in FIGS. 3(*a*) and 3(*b*) to the activated/radially extended outwards and cutting or slotting configuration shown in FIGS. 4(*a*) and 4(*b*).

It should be noted however that the cutting wheel 60 is not reliant on the force created by the pressure of said fluid to stay engaged with the inner surface of the casing 102 or indeed is not reliant on said force created by the fluid pressure to cause the cutting/slotting action through the casing 102. Rather, as the drill string 120 is moved downwards during operation of the method used for actuation of this first embodiment of slotting and jetting tool 10 (by the operator setting down weight (particularly in relatively vertical wellbores 100) and/or actively pushing downwards at the surface on the drill string 120 (particularly in relatively deviated wellbores 100) in order to lower the drill string 120 further into the wellbore 100) and as will be described subsequently, the cutting wheel 60 is not only kept forced outwards in the activated/radially extended outwards configuration due to the ramped shape of the slotted ramp 55, in that the slotted ramp 55 acts as a wedge to keep the cutting wheel 60 in the activated/radially extended outwards configuration, but the effect of the ramp 55 actually causes the cutting wheel 60 to be forced even further outwards and therefore to cause the slots 108 through the sidewall of the casing 102.

Accordingly, the first embodiment of the slotting and jetting tool 10 disclosed herein can be considered to have two stages of activation:— a) a pressure activation stage in which fluid pressure is applied down the throughbore of the drill sting 120 from the surface of the wellbore 100 in order to act upon the lower face of the piston head 43 of the activation piston 40 in order to force the piston head 43 and thus the piston rod 44, wheel mount 50 and thus the wheel axle 64, wheel hub 62 and most importantly the cutting wheel 60 in:— i) an axially upwards direction and also a radially outwards direction such that the cutting wheel 60 will move from the stored/inactive/running in hole configuration shown in FIGS. 3(*a*) and 3(*b*) to the activated/radially extended outwards and cutting or slotting configuration shown in FIGS. 4(*a*) and 4(*b*) although it should be noted that it is unlikely that the force applied by the fluid pressure alone will be sufficient to force the cutting wheel's 60 cutting tips through the sidewall of the casing 102 to form the slots 108;

AND b) a drill string movement activation stage—in which downwards movement of the drill string 120 by the operator will further force the cutting wheel 60 further up the ramp 55 and thus will be further forced radially outwards with significant levels of force sufficient to force the cutting wheel's 60 cutting tips through the sidewall of the casing 102 to form the slots 108.

In operation, this has a great advantage over conventional means of cutting through the sidewall of casing 102 downhole, where such conventional means typically rely on fluid pressure activated cutting means such as high speed cutting blades and the like, because much greater force can be applied to the cutting wheel 60 (and thus to the cutting tips thereof in order to form the slots 108 in the casing 102 sidewall as will be subsequently described) given the very high weight load that can be applied due to the very heavy weight of the drill string 120 (especially in relatively vertical wells).

However, reduction of the pressure of fluid within the throughbore 14 by the operator at the surface will reduce the force of that pressurised fluid acting upon the lower most face of the piston head 43 and thus the coiled spring 45 will bias the piston head 43 and thus the piston rod 44 and ultimately the cutting wheel 60 both axially downwards and also radially inwards in order to return the cutting wheel 60 to the inactive configuration shown in FIGS. 3(*a*) and 3(*b*) (or 6(*a*) and 6(*b*) if a drop ball 68 has been dropped as will be described subsequently). Moreover, the cutting wheel 60 will automatically return to the inactive configuration when the string 120 is picked up at the surface by the operator and the spring and the ramped nature of the shape of the slotted ramp will aid this return (once the pressure has been bled off).

The ball seat 70 is advantageously shear pin coupled to the ball seat carrier 72 by means of a (third) set of shear pins 73 and which have a higher shear strength than the (second) set of shear pins 15 such that the (third) set of shear pins 73 will remain intact in place after the (second) set of shear pins 15 have sheared and thus an operator can obturate the throughbore 14 until the operator is ready to start circulation of fluid below the slotting and cutting tool 10 (in particular, to circulate isolation material such as cement 112 down below the cups 20 once the cups 20 are located in a non-slotted hole section) at which point the operator can pressure up the fluid at surface which results in pressure acting upon the drop ball 68 and ball seat 70 and once the force reaches the critical point of shearing the (third) set of shear pins 73, they 73 will shear and thus the ball seat 70 and drop ball 68 will fall through the ball seat carrier 72 and thus the fluid (such as isolation material 112) will be able to pass through the throughbore 14 and into the inverted float (shear) sub 30 below, as will be described subsequently in more detail.

The cutting wheel 60 is generally disc shaped but further comprises a serrated or castellated outer circumference such that the cutting wheel 60 comprises a number of cutting tips circumferentially equi-spaced around its circumference and which are therefore separated by gaps in order to increase the cutting force applied to the cutting tips. The cutting tips of the cutting wheel 60 may be suitably coated (such as tungsten or diamond coated for example) to provide a very hard cutting surface to aid slotting, cutting or slicing through the casing 102 as will be subsequently described.

Inverted Float (Shear) Sub 30

The inverted float (shear) sub 30 is shown in detail in FIGS. 2(*e*) and 2(*f*), and also in FIG. 5. As particularly seen in FIG. 2(*e*), the inverted float (shear) sub 30 comprises a tubular outer body or mandrel 32 having a throughbore 34. A flapper valve 36 is pivotally mounted at one side to a slidable valve housing 38 by means of a pivot pin 37. The slidable valve housing 38 is initially located axially in place within the throughbore 34 of the mandrel 32 at the position shown in FIG. 2(*e*) by means of a (first) set of shear pins 39. Moreover, the slidable valve housing 38 is at least initially located within the throughbore 34 at an axial position such that it sealingly obturates a circumferentially arranged (first) set (i.e. a plurality) of jetting nozzles/circulation ports 31 which are formed through a side wall of the mandrel 32 all the way (i.e. 360 degrees) around the circumference of the mandrel 32 and the slidable valve housing 38 is initially sealed to the inner surface 35 of the mandrel 32 by an upper and lower pair of O-ring seals 33.

The inverted float (shear) sub 30 is arranged such that the flapper valve 36 can be open when the BHA 1 is running in-hole, such that the wellbore fluid can pass therethrough, allowing the running in of the BHA 1. However, when the pressure of fluid at the surface is increased by the operator, that increase is of course transmitted to the fluid within the throughbore 34, and the flapper 36 will shut in order to seal the throughbore 34 and thus no further fluid can pass down through the throughbore 34 past the flapper valve 36 and thus the flapper valve 36 is now in the closed flapper configuration as shown in FIG. 2(*f*). However, if the operator wishes to open the (first) set of jetting nozzles/circulation ports 31, the operator can increase the pressure of fluid at the surface pumped down the throughbore of the drill string 120 and as long as there is no drop ball obturating the throughbore 14 of the slotting and jetting tool 10, the pressure acting upon the closed flapper 36 will increase up to the point (for example a pre-determined pressure of say 2500 PSI) that the (first) set of shear pins 39 fail and at that point the slidable valve housing 38 will move downwards from the configuration shown in FIG. 2(*f*) until it reaches the position shown in FIG. 5 at which point the (first) set of jetting nozzles/circulation ports 31 have been uncovered and thus the fluid pumped down and located in the throughbore 34 will be jetted out through the (first) set of jetting holes/circulation ports 31 formed through the side wall of the mandrel 32 of the inverted float (shear) sub 30.

Description of Method of Plugging and Abandonment of a Wellbore Using the First Embodiment of the Slotting and Jetting Tool 10

A method of plugging and abandoning a wellbore in accordance with the present invention will now be described.

The following steps or stages of the method should generally be followed in the numerical order indicated below but some steps may be operated or performed in a different order and/or may be omitted.

Running and Slotting Procedure

Stage 1—FIG. 1 and FIG. 9

The operating personnel responsible for the BHA 1 incorporating the first embodiment of the slotting and jetting tool 10 will visually inspect the BHA 1 at surface on the drilling rig floor prior to including the BHA 1 in the drill string 120 and in particular visually inspect the slotting and jetting tool 10 in order to ensure that it is in full working order.

Stage 2—FIG. 1 and FIG. 9

The operating personnel will include the BHA 1 in the drill string 120 on the drill rig floor and will conduct a surface function test of the slotting blade/cutting wheel 60 and the single jetting nozzle 80 by pressuring up the fluid in the throughbore 14 to the required operating pressure (which may for example be 1750 PSI but other pressures may be used as pre-determined by the operator) to ensure they are in good working order prior to Running In Hole (RIH).

Stage 3—FIG. 9 and FIG. 10

A conventional bridge plug 110 can be set within the wellbore 100 at a location just below the slot jet area 106 of the wellbore 100 (which is same as the area of the casing 102 to be slotted 130 with slots 108) where the slotting and jetting tool 10 will be used to slot 108 the casing 102, the bridge plug 110 serving to seal the throughbore 103 of the wellbore 100 at that location. The bridge plug 110 can either be run into the wellbore 100 prior to the BHA 1 being run into the wellbore 100 or the bridge plug 110 can be suitably attached to the lower end of the BHA 1 and run into the wellbore 100 with the BHA 1 and can be deployed, sealed and then detached from the BHA 1 by conventional means.

Either way, the BHA 1 incorporating the slotting and jetting tool 10 is run into the wellbore 100 until it reaches the upper end of the lateral isolation placement depth which in general is the area of the casing to be slotted 130 and (ultimately) to be filled with isolation material 112 (such as cement or the like) in the subsequent steps.

The BHA 1 should be run into the wellbore 100 at a maximum running speed of approximately 90 feet per minute inside the casing 102 particularly when the inner diameter of the casing 102 is the same size as the diverting cups 20 in order to avoid swab surging or hydraulic lock occurring due to the fluid bypass channels (hereinbefore described but not shown in the drawings) around or through the cups 20 being overwhelmed.

The slotting and jetting tool 10, when in the running in-hole (RIH) configuration, is as shown in FIGS. 3(*a*) and 3(*b*) where the activation piston 40 is in the relaxed position due to it not experiencing any significant and/or sufficient fluid pressure. The inverted float (shear) sub 30 is shown in its running in-hole configuration (opened) in FIG. 2(*e*) where the flapper valve 36 is shown in its open configuration such that the inverted float (shear) sub 30 can pass down through the wellbore fluid located in the throughbore 103 of the casing 102. The BHA 1 and drill string 120 is now at the position in the wellbore 100 as shown in FIG. 11.

Stage 4—FIG. 11

The operator will, at surface, record the up and down weight of the drill string 120, said weights typically being dictated by the:

depth;
well inclination;
fluid;
torque & drag of the wellbore 100 geometry; and
string configuration; etc. etc.

Stage 5—FIG. 11

Prior to functioning the BHA 1 and in particular the slotting and jetting tool 10 and inverted float (shear) sub 30, the operator will likely run the BHA 1 to its maximum in use depth (i.e. just above the bridge plug 110) and will then pick the drill string 120 back up such that the BHA 1 is pulled back up to be aligned with the top of the lateral isolation placement depth (i.e. the uppermost end or top of the slot jet area 106) and therefore the top of the area of the casing to be slotted 130. By performing this step, the operator will therefore know how many stands of drill pipe are required to make up that depth and also the operator will then install an open conventional TIW/Kelly valve (not shown) in the drill pipe string 120 at the drill pipe floor level, the number of TIW/kelly valves required being dictated by the depth or length of the slot jet area 106.

Stage 6—FIG. 12

The operator will pressure up the drill string 120 to an appropriate pressure such as 1,250 psi in order to close the inverted float flapper valve 36 (as shown in the closed position in FIG. 12 and in more detail in FIG. 2(*f*)) such that the flapper valve 36 moves from the open position shown in FIG. 2(*e*) to the closed position shown in FIG. 2(*f*).

Stage 7—FIG. 12

The operator can now activate the slotting blade or cutting wheel 60 by pressuring up the throughbore of the drill string 120 to an appropriate pressure such as 1,500 psi and that fluid pressure will act against the upper surface of the now closed flapper valve 36. That increased pressure is calculated or pre-determined to be sufficient to now act on the activation piston 40 such that it will move the piston head 43 and thus the piston rod 44 upwards such that the slotting blade or cutting wheel 60 is moved both upwards and radially outwards along the slotted ramp 55 from the configuration shown in FIGS. 3(*a*) and 3(*b*) to the extended configuration shown in FIGS. 4(*a*) and 4(*b*) such that the slotting blade/cutting wheel 60 extends radially outwards firstly beyond the outer diameter of the mandrel 13 and then secondly is forced against the inner surface of the casing 102 and then thirdly, due to the wedge action provided by the slotted ramp 55 as the BHA 1 is moved downwards, punctures, cuts or slots through the side wall of the casing 102 in order to form a slot 108 therein. In addition, the slotting blade/cutting wheel 60 will further extend and puncture, cut and slot into and through the old cement 104 (and potentially the formation itself) located in the annulus between the outer surface of the casing and the borehole wall 105.

Stage 8—FIG. 12

After the operator has confirmation of the blades 60 full travel upward and outwards and that casing 102 has begun to be slotted 108, the operator will continue to pressure up the string further to, for example, 1,750 psi pressure and in so doing will cause significant jetting of fluid through the single jetting nozzle 80 located directly vertically above and longitudinally aligned above the extended slotting blade/cutting wheel 60.

The pressurised fluid in the throughbore 14 of the mandrel 13 of the slotting and jetting tool 10 will therefore be forced out through the single jetting nozzle 80 in order to ensure that the washing fluid will wash through the slots that have just been formed through the casing 102 as the slotting and jetting tool 10 is moved downwards in subsequent steps (for example in step 9) because the single jetting nozzle 80 is circumferentially and longitudinally aligned with the slotting blades/cutting wheel 60, and because it is located vertically above the cutting wheel 60 it will permit the pressurised cleaning/washing fluid to be jetted through the slots 108 that have just been formed.

Stage 9—FIG. 13

The operator will now set down weight on the drill string 120 such that the BHA 1 and more importantly the slotting and jetting tool 10 are moved downwards for example by 3 feet such that the slotting blades/cutting wheel 60 forms a number of longitudinally spaced apart slots 108 through the side wall of the casing 102 with its cutting tips as previously described.

Furthermore, the upper 20U and lower 20L pair of jetting cups ensure that the washing fluid which is highly pressurised to, for example 1,750 psi, is directed out through those slots 108 because the outer surfaces of the cups 20 are in sealed and sliding engagement with the inner surface of the casing 102.

Stage 10

The operator can then, if desired, perform an optional flow check by performing the next three stages. They can initiate this by shutting down the pumps at surface which supply the pressurised washing fluid down the throughbore of the drill string 120 in order to bleed the washing fluid pressure off.

Stage 11

The operator can then pick up the drill string 120 by for example 5 feet such that the BHA 1 is now located above the slot jet area 130 and therefore above the slots 108.

Stage 12

The operator can then apply an increased washing fluid pressure by initiating pumps again at surface and supply for example 2,000 psi (but other pressures may be used as pre-determined by the operator) of pressure down the throughbore of the drill string 120 and can test the integrity of the cups 20.

Importantly, the pressure at which the integrity check of the cups 20 is performed is arranged to be lower than the slotting blade/cutting wheel 60 activation pressure of the activation piston 40.

Accordingly, because the cups are arranged in a non-slotted area (i.e. they are positioned above the slot jet area 130), the integrity of the cups 20 can be tested in that there should be no washing fluid loss because all of the washing fluid should be retained within the area defined by the upper 20U and lower 20L jetting cups and therefore there should be no loss of washing fluid if the integrity of the cups 20 is in place.

Stage 13—FIG. 14

The operator will move the drill string 120 downwards and will observe washing fluid pressure bleed off when the cups 20 pass over the slots 108. The operator will then shut down the washing fluid pumps at surface. This stage 13 ensures that the casing 102 has been slotted 108 and stage 12 has also confirmed that the integrity of the cups 20 is in good condition.

Stage 14—FIG. 14

The operator will then start to commence further slotting by activating the activation piston 40 by pressuring up the drill string to for example 1,500 psi again against the inverted closed flapper valve 36.

Stage 15—FIG. 14

After the operator has confirmation of the slotting blade/cutting wheel 60 full travel upwards and radially outwards along the axially extending angled slotted ramp 55, and has confirmation that the casing 102 is being slotted 108, the operator will continue to pressure up the drill string 120 to 1,750 psi pressure again to start jetting from the single jetting nozzle 80 again.

Stage 16—FIG. 14

The operator will again move the BHA 1 and therefore the slotting and jetting tool 10 downwards within the slot jet area 130 of the wellbore 100 and will monitor the stand pipe pressure of the washing fluid at surface for any fluctuation in that pressure—fluctuation of the pressure will indicate to the operator that the old cement or formation 104 is bridging the slots 108 and has therefore not yet been washed out. If such fluctuation of pressure is observed, the operator will continue to wash the cement for a longer period of time until no fluctuation of such pressure is observed.

Stage 17—FIG. 14

Once the operator has lowered the BHA 1 down 200 feet of travel and has therefore caused 200 feet of slot jet area 130 to be slotted 108, the operator will shut down the washing fluid pumps and will bleed off the washing fluid pressure.

The operator will check the tally of drill pipe stands inserted into the drill string 120 to ensure that the correct depth has been reached.

Stage 18—FIG. 14

If for example the slot jet areas 130 is to be 200 feet, the operator will pick up the drill string 120 by 205 feet such that the BHA 1 is located 5 feet above the slot jet area 130 and therefore the cups 20 are compressed against the inner surface of the casing 102 at a location at which there are no slots therein.

Stage 19—FIG. 14

The operator will then apply a suitable pressure such as 2,000 psi to the washing fluid that is pumped down through the drill string 120 in order to check the integrity of the cups 20 and again that pressure is to be below the slotting blade/cutting wheel 60 activation pressure.

The operator does that by ensuring that the cups 20 are placed in a non-slotted area of the casing 102.

Stage 20

The operator will move the BHA 1 and therefore the slotting and jetting tool 10 five feet down into the wellbore.

Stage 21

The operator will then rotate the drill string by any suitable number of degrees between 45 to 90 degrees of phasing (which will be confirmed on location during execution of the plugging and abandonment operation depending upon if the operator wishes for example four to 8 vertically extending lines of slots 108 formed through the casing 102). The skilled person will understand however that greater or fewer longitudinally extending columns of slots 108 may be formed by varying the degrees of rotation imparted to the BHA 1.

It should be noted that the operator can rotationally lock and unlock the BHA 1 from the rest of the work string 120 by operating the swivel 90 (which can be achieved by different methods depending upon what type of locking mechanism is incorporated in the swivel tool 90, such as rotating the work string 120 with lefthand turn rotation of the work string 120 at surface by the operator or the other way round. Alternately, there are swivel tools 90 that are pressure activated i.e. when pressure is applied, the swivel tool 90 allows the work string 120 to rotate with respect to the BHA 1 etc.).

Stage 22

The operator will then repeat steps 12-21 in order to provide another vertically extending and vertically spaced apart column of slots 108 through the side wall of the casing 102 and will wash out the old cement or formation 104 in the annulus behind those slots 108.

Stage 23—FIG. 14

After the operator has confirmation of one or more repeated stage 22, the operator will run the drill pipe string 120 down to the bottom and place the slotting and jetting tool 10 in line with the bottom slot 108.

Final Jetting Procedure

Stage 24

The operator will, at surface, record the up and down weight of the drill string 120, said weights typically being dictated by the:

depth;
well inclination;
fluid;
torque & drag of the wellbore 100 geometry; and
string configuration; etc. etc.

Stage 25

The operator will place the cups 20 against the inner surface of the casing 102 below the lower most slots 108 and therefore below the slot jet area 130.

Stage 26—FIG. 15

The operator will then pressure up the fluid in the throughbore of the string 120 to a suitable pressure, such as for example 2,500 psi and in so doing will shear the first set of shear pins 39 in the BHA 1, those being the set of shear pins 39 provided in the inverted float (shear) sub 30. The shearing of the shear pins 39 will cause the slideable valve housing 38 to drop downwards, thus uncovering the (first) set of circulation ports 31 and therefore providing circulation of washing fluid out of the throughbore 34 through the (first) set of jetting nozzles/circulation ports 31 and therefore providing for a 360 degrees of fluid circulation below the slotting and jetting tool 10. The inverted float (shear) sub 30 is now in the configuration shown in FIG. 5 and the rest of the BHA 1 is shown in the configuration shown in FIG. 15, where the inverted flapper valve 36 has been moved below the (first) set of jetting nozzles/circulation ports 31.

Stage 27—FIG. 16 and FIGS. 6(*a*) and (6*b*)

The operator will then drop a drop ball 68 down the throughbore of the drill string 120 and will allow gravity to pull the drop ball 68 to depth until it lands on the ball seat 70, and the pumping of fluid down the throughbore of the drill string 120 will of course greatly aid and speed the landing of the drop ball 68 on the ball seat 70. The throughbore of the drill string 120 above the ball seat 70 and drop ball 68 is therefore blocked and fluid pressure applied at surface by the operator can therefore increase thereon.

Stage 28—FIGS. 7(*a*), 7(*b*) and FIG. 17

The operator will then pressure up the washing fluid pumped into the throughbore of the drill string 120 to a suitable pressure such as 2,000 or even 2,500 psi and in so doing will shear the second set of shear pins 15 provided in the BHA 1, namely the set of shear pins 15 provided in the slotting and jetting tool 10 which are sheared because the fluid pressure builds up due to the drop ball 68 obturating the throughbore 14. The ball seat carrier 72 thus drops to the position shown in FIGS. 7(*a*) and 7(*b*) and in so doing uncovers the 360 degree and second set of jetting nozzles/circulation ports 74. Accordingly, the washing fluid flow is changed such that it will also and/or mainly flow out of the 360 degree (second) set of jetting nozzles/circulation ports 74.

Stage 29—FIG. 17

The operator will pressure up the string 120 to a suitable pressure such as 2000 psi (or any other suitable pressure as pre-determined by the operator) and will start to rotate the string 120 above the slotting and jetting tool 10 to a maximum of 120 RPM if required, although if the wellbore 120 is shallow then no rotation may be required (for example if the wellbore is above a depth of 3,000 feet, then no rotation may be required). The swivel tool 90 located above the slotting and jetting tool 10 will therefore rotationally decouple the slotting and jetting tool 10 and indeed the rest of the BHA 1 such that they will not experience that rotation. The operator may well wish to rotate the string 120 in order to create velocity (i.e. turbulent force) in the wellbore fluid surrounding the string 120, where this velocity assists in the lifting of any cuttings 104 from the annulus between the outer surface of the string 120 and the inner surface of the casing 102, thereby assisting the lifting of such material 104 such as the cuttings to the surface.

Stage 30—FIG. 17

The operator will then pick up the drill string 120 and will jet washing fluid between the cups 20 via the 360 degrees (second) set of jetting nozzles/circulation ports 74 and will monitor the standpipe pressure at surface for any bridging occurring in the annulus 104.

Stage 31

After the operator has obtained confirmation of 360 degrees of jetting fluid being pumped through the (second) set of jetting nozzles/circulation ports 74 and has noted 200 feet of clean annulus 104 (i.e. with no old cement left in the annulus 104), the operator will shut down the fluid pumps and will stop rotation of the drill string 120.

Stage 32—FIG. 18

The operator will know that he has a clean annulus 104 due to that being indicated by no fluctuations of spikes in the standpipe pressure at surface and instead the operator will observe a consistent pressure at surface during the final jetting procedure. If so, the operator will proceed to stage 33. If not, the operator can repeat Stages 29 to 31.

Stage 33

The operator will run the drill string 120 back in hole such that the BHA 1 and slotting and jetting tool 1 are located in line with the bottom slots 108.

Stage 34

The operator will conduct a flow check to ensure that everything is ready for the isolation/cementing procedure to follow.

Isolation/Cementing Procedure

Stage 35

The operator will mix and then pump whatever mix of suitable isolation material is desired, as determined by the cementing specialist on the drilling rig, such as:— a) spacer fluid material, followed by;

b) isolation material 112 (such as cement or similar); and c) spacer material;

with an appropriate cementing unit (not shown) at surface (e.g. on the drilling rig floor (not shown)).

Stage 36—FIG. 19

The operator will then pump that spacer material followed by the isolation material 112 followed by the next batch of spacer material at a reduced rate down through the throughbore of the drill string 120 until it arrives at and passes through the (second) set of 360 degree jetting nozzles/circulation ports 74 and until the BHA 1 has been submerged in isolation material/cement—see FIG. 19. Accordingly, such pumping will result in the isolation/cement material 112 filling the throughbore 103 of the casing 102 from above the bridge plug 110 until the isolation material/cement 112 is located above the upper cup 20U. This ensures that the entire slotting and jetting tool 10 is submerged in isolation material such as cement or similar 112.

Stage 37

The operator starts to pull the drill string 120 out of the wellbore 100 whilst pumping isolation material 112 down through the throughbore of the drill string 120 in order to jet the isolation material 112 through the second set of 360 degrees jetting nozzles/circulation ports 74, such that the slotting and jetting tool 10 is always submerged by the isolation material 112 as it is being pulled out of the wellbore 100.

The operator will continue to rotate the drill pipe string 120 whilst pulling it out of the wellbore 100 until the operator has pulled enough drill string 120 out of the wellbore 100 such that he can remove one stand of drill pipe.

Stage 38

The operator will stop pumping the isolation material 112 and will instead breakout that one stand of drill pipe.

Stage 39

The operator will continue to pull out the drill pipe string 120 out of the wellbore 100 and will alternatively stop pumping the isolation material 112 and will break out the stands of drill pipe.

Stage 40—FIG. 20

The operator will continue to pull the drill pipe string 120 out of the wellbore 100 until, importantly, the BHA 1 is located above the theoretical top of the isolation material and above the top (shallowest) slots 112 W/O (WithOut) the operator rotating the drill pipe string 120 at the surface; the operator may wish to do this because stopping rotation will limit the contamination of pump fluid, spacer and the isolation material such as cement 112 (i.e. no turbulent force to mix everything together).

Stage 41—FIG. 21

The operator will pressure up the isolation material 112 in the drill string 120 to a pre-determined pressure such as for example 3000 psi (although the pressure could be different as decided by the operator) and in so doing will shear the third set of shear pins 73 which act between the ball seat 70 and ball seat carrier 72 which will then open up circulation of fluid through the throughbore 14 and thus the jetting and cutting tool 10 is now in the configuration shown on FIG. 8(*a*) and FIG. 8(*b*). Accordingly, the isolation material 112 such as cement can be now pumped down into the throughbore 34 of the inverted float (shear) tool 30 and out through the (first) set of 360 degree jetting nozzles/circulation ports 31 in order to obtain circulation of isolation material 112 below the jetting and cutting tool 10. In other words, the operator is able to change the flow path of the isolation material:— a) from down the throughbore of the string 120 and out of the string 120 through the single jetting nozzle 80 and more importantly the 360 degree set of jetting nozzles 74 in between the upper 20U and lower 20L sets of cups 20 and through the slots 108;

b) to down the throughbore of the string 120, down the throughbore 14 of the slotting and jetting tool 10 and into the throughbore of the inverted float (shear) sub 30 and out through the second set of jetting nozzles/circulation ports 31 (i.e. below the lower most cups 20L.

Stage 42—FIG. 22

The operator will then circulate the wellbore 100 clean at the maximum loss free rate with cleaning fluid.

Stage 43

The operator will space out (i.e. place the string at the correct place at the surface to ensure nothing is preventing the BOP(s) (not shown) from shutting) and clean up the wellbore 100 with appropriate cleaning fluid and close the annular BOP at the surface of the wellbore 100.

Stage 44

The operator will wait on isolation material 112 to set and if needs be will pressure up the wellbore 100 as required to aid the setting of the isolation material 112. This Stage 44 can be swapped with Stage 45 if desired.

Stage 45—FIG. 23

Once the isolation material 112 is set, the operator will pull the entire drill string 120 and BHA 1 out of the hole and lay down or layout drill pipe and slotting and jetting tool 10.

Technical Benefits Realised which Result from Embodiments of the Present Invention Compared with Current Technology The BHA 1 and in particular the inverted float (shear) sub 30 and the slotting and jetting tool 10 provide the advantage of enabling a one trip annulus remediation system deployed on drill pipe 120 at considerably lower cost and risk compared with current techniques (particularly those that utilise perforating gun systems).

The BHA 1 allows placement of a lateral barrier (rock to rock) in the form of the isolation material such as cement 112 which is particularly useful in hydrocarbon wellbores 100 (which are considerably more complex than e.g. water wellbores) without having to pull or section mill the casing 102 or liner string 102.

The embodiments of BHA 1 allow for slotting of casing between 4.5 inch diameter up to 20 inch diameter casing 102.

Moreover, the cutting wheel 60 design permits perforation of a casing string 102 and can provide for example a one inch length by 0.25 inch width slot size for each slot 108 and can provide a gap in the region of 1.5 inches between each slot 108.

The BHA 1 therefore enables a repeatable mechanical multiuse slotting system and moreover provides two different jetting systems in the slotting and jetting tool 10 within the one tool 10 and provides a further jetting system within the inverted float sub 30.

In an alternative embodiment of the BHA 1, the cups 20 and associated cup tools 22, 24 could be omitted and whilst that has the disadvantage of not providing the captured volume through which the second set of jetting ports/circulation holes 74 can flow into, in such an embodiment, the rest of the BHA 1 can be modified to suit other applications (for example by using a second larger drop ball (not shown) to knock against the first drop ball 68 and shear the third shear pins 73 in order to open up the circulation through the throughbore 14 again).

Embodiments of the present invention allow a bypass of fluid when running the BHA 1 into the wellbore 100 and also when pulling out of the hole by virtue of the fluid bypass channels around, through or within the cups 20.

In addition, the BHA 1 enables 360 degree jetting of fluid (whether washing fluid or cement/isolation material 112) after the slotting 108 has occurred.

In addition, there are various key performance indicators available to the operator at the surface during the operation of the method hereinbefore described such as pressure, weight and fluid returns.

There are many advantages and benefits obtained by performing embodiments of the present invention such as:—

- Less/no permitting by safety authorities required due to the system not using any perforation guns.
- no perforation gun re-stocking charge required as the embodiments are explosive free.
- the method enables a single trip system with no sump required.
- the method enables the ability to remove and wash ratty or poorly formed cement or other suitable materials 104.
- the embodiments provide standoff after the slots 108 have been formed and as such elevates the casing 102 off of the low side and this is beneficial if the casing 102 is actually a liner located within a casing and is lying on the casing of if the casing 102 is lying on a more horizontal section of the wellbore 100—the stand off can allow fluid to pass through the gap or annulus provided by the standoff. the embodiments of the present invention will ensure clean slots 108 are provided due to the ability to jet whilst slotting.
- the slotted length can be changed when in hole. Moreover, there is no waiting for final interpretation of log results before running in hole. This provides major benefits whilst conducting the operation because the operation can be changed if log results show differences to the anticipated well profile, whereas perforation guns need to be set up in advance and can't be changed during running in hole.
- the embodiments of the present invention minimise the man power that is required on location, due to the avoidance of perforation guns.
- embodiments of the present invention can be adapted for different casing sizes whilst on location, such as a drilling rig.

Safety factor of not handling explosives with stored energy.

No requirement to dispose of harmful gases produced from explosives which add additional time to the execution timings and furthermore, significant environmental benefits are achieved by not having to capture potentially harmful gasses.

Example Pressure Applied for Shear Values:

| | |
|---|---|
| 1st set of shear pins 39 (in the Inverted Float (shear) sub 30) - | 2500 psi |
| 2nd set of shear pins 15 (in the slotting and jetting tool 10) - | 2500 psi |
| 3rd set of shear pins 73 (in the slotting and jetting tool 10) - | 3000 psi |

Second Embodiment of (Inverted) Slotting and Jetting Tool 210

A second embodiment of slotting and jetting tool 210 is also provided as an alternative to the first embodiment, albeit in some circumstances and particularly with differently sized drop balls and/or differently assigned activation pressures, the skilled person could envisage running both the first embodiment of slotting and jetting tool 10 and the second (inverted) embodiment of slotting and jetting tool 210 into the wellbore 100 spaced apart on the same work string 120 wherein the skilled person could operate either slotting and jetting tool 10; 210 in turn as per their requirements.

Overall, the second (inverted) embodiment of the slotting and jetting tool 210 is particularly useful when an operator wishes to form the slots 80 in the casing 102 by pulling up on the work string in order to apply upwards directed force to the inverted slotting and jetting tool 210 (as opposed to pushing down on the drill string 120 in order to apply downwards directed force to the first embodiment of the slotting and jetting tool 10).

The second (inverted) embodiment of slotting and jetting tool 210 is relatively similar to the first embodiment of slotting tool (and where that is the case, the same reference numeral has been used but with the addition of 200 in relation to the same/similar component/function and for such components/functions, their further operation will not be repeated again).

However, the main difference between the two embodiments is that the second embodiment of the slotting and jetting tool 210 is inverted (i.e. it can basically be considered by a skilled person to be an upside down version (in concept) when compared to the first embodiment of slotting and jetting tool 10), in that for example:— i) the ball seat carrier 272 is (at least initially) secured within the throughbore 214 of the mandrel 213 to the inner surface 214S thereof by a set 215 of shear pins such that whilst the set of shear pins 215 remain intact, the ball seat carrier 272 remains in position as shown in FIG. 24(*a*) to 24 (*c*) and therefore by means of the ball seat carrier 272 being connected to a sleeve cover 299 (which in the configuration and position shown in FIGS. 24 (*a*) to (*c*) covers over and therefore obturates the set of (a plurality of) 360 degrees jetting nozzles/circulation ports/washing ports 274 which are equispaced around the circumference of the mandrel 213 formed through the side wall thereof thus providing a 360 degree coverage of fluid jetting function when they have been uncovered (when the sleeve cover 299 is moved downwards) as will be described subsequently. However, whilst the ball seat carrier 272 is shear pinned in place by the set of shear pins 215, no fluid can pass from the throughbore 214 through the (second) plurality or set of jetting nozzles/circulation ports/washing ports 274 due to the presence of one or more suitable seals such as O-ring seals (not shown) located and acting in between the outer surface of the ball seat carrier 272 and the inner surface 214S of the mandrel 213 at a location above and below the (second) set of jetting nozzles/circulation ports 274;

ii) there is further provided a single jetting nozzle 280 formed through the side wall of the mandrel 213 at a position some way below the ball seat carrier 272 and is moreover and importantly now also located below the cutting wheel 260 and which is preferably circumferentially aligned (aligned on the same longitudinal axis or plane) with the slotting blade or cutting wheel 260 and which in use will provide a jetting action to jet through the slots 108 that are punctured through the casing 102 along the length or area of casing to be slotted 130 by the cutting wheel 260 in order to jet or wash away the old cement or formation or indeed unwanted gas or other fluid) 104 in the annulus in a slot jet area 106 between the outer surface of the casing 102 and the inner surface of the borehole 105. Further details of the use of the single jetting nozzle 280 will be described subsequently;

iii) the activation piston 240 comprises an upwardly projecting cylinder 242 having a piston head 243 located within the cylinder 242 at the uppermost end thereof, where the piston head 243 is provided at the upper end of the piston rod 244 and where the spring 245 (which may be a coiled spring 245 or leaf washers or any other suitable spring) acts between an upper surface of the mandrel 213 and the lower face of the piston head 243 and wherein the spring 245 acts to bias the piston head 243 and thus the piston rod 244 into the non-activated position/configuration of the slotting and jetting tool 210 shown in FIG. 24(*b*) (due to it not experiencing any significant and/or sufficient fluid pressure). The upper face of the piston head 243 is in use in fluid contact with the fluid located in the throughbore 214 and the outer circumferential surface of the piston head 243 is sealed to the inner surface of the cylinder 242 by a suitable seal such as an O-ring seal (not shown) or the like;

iv) the lower end of the piston rod 244 is pivotally coupled to the wheel mount 250 upon which is mounted the slotting blade in the form of the cutting wheel 260 by means of the wheel hub 262 and the wheel axle 264. The wheel hub 262 and wheel axle 264 can furthermore lie within the axially extending and angled slotted ramp 255. The slotted ramp 255 is angled such that it angles (preferably linearly) outwardly from the longitudinal axis or centre line 257 of the slotting and jetting tool 210 as it axially extends downwards (i.e. the ramp 255 is inverted with respect to the first embodiment's ramp 55). Accordingly, the upper end of the slotted ramp 255 is closer to the centre line 257 of the slotting and jetting tool 210 than the lower end of the slotted ramp 255. The wheel axle 264 is located on its rotational axis which is perpendicular to the radius of the slotting and jetting tool 210 extending from the centre line 257. Accordingly, the activation piston 240 is arranged such that an increase in fluid pressure within the throughbore 214 acts upon the upper face of the piston head 243 and will therefore force the piston head 243 and thus the piston rod 244, wheel mount 250 and thus the wheel axle 264, wheel hub 262 and most importantly the cutting wheel 260 in both an axially downwards direction and also a radially outwards direction such that the cutting wheel 260 will move from the stored/inactive/running in hole/non-activated configuration shown in FIGS. 24(*a*) to 24(*c*) to the activated/radially extended outwards and cutting or slotting configuration shown in FIGS. 27(*a*) and 27(*b*);

v) the inverted slotting and jetting tool is further provided with a selectively slidable piston cylinder sleeve 291 (shown in dotted lines in FIGS. 24(*a*) to (*c*)) as being in the form of a cylinder and which is arranged in a co-axial manner around the outside of the upwardly projecting cylinder 242. The upper most end of the piston cylinder sleeve 291 is secured to the lower face of the drop ball seat carrier 272 and the lower most end of the piston cylinder sleeve 291 is secured to the upper face of the sleeve cover 299, such that when the drop ball seat carrier 272 is shear pinned 215 to the inner surface 214S of the mandrel 214, the piston cylinder sleeve 291 and the sleeve cover 299 are fixed in position (with the latter sealing the set of jetting nozzles/circulation ports/washing ports 274).

An upper 296 and a lower 297 set of bypass ports are formed through the side wall of the piston cylinder sleeve 291 towards its upper end, where the upper 296 and lower 297 ports are spaced apart about a blade piston back pressure valve 292 (which is shown in the shape of a solid cone but could be any other suitable shape such as a flat disc of ball or the like suitably shaped that firstly provides a blockage in the throughbore of the piston cylinder sleeve 291 and secondly can cover over the upper face of the piston head 243 when required, as will be detailed subsequently). The blade piston back pressure valve 292 is arranged to provide a blockage or obturation in the throughbore of the piston cylinder sleeve 291 at that location between the upper and lower 297 set of bypass ports. Accordingly, whilst the shear pins 215 remain in place and thus the piston cylinder sleeve 291 remains fixed in the position shown in FIGS. 24 (*a*) to (*c*), fluid flowing from the surface down through the throughbore of the work string will pass through the ball seat 270, down into the throughbore of the piston cylinder sleeve 291, out through the upper set of bypass ports 296 into the throughbore 214 of the mandrel 213 and can then flow back into the throughbore of the piston cylinder sleeve 291 and can thus then act upon the upper face of the piston head 243; in doing so, the fluid was able to bypass the blade piston back pressure valve 292 and can, if the pressure of the fluid is increased sufficiently, can move the piston head 243 and thus the cutting wheel 260 into the activated configuration to allow slotting to be commenced by pulling up on the inverted slotting and jetting tool 210.

However, when the shear pins 215 are sheared (due to pressure build up above the drop ball 268 when it is seated), the drop ball seat carrier 272, piston cylinder sleeve 291 and the sleeve cover 299 are moved downwards:— i) firstly uncovering the set of jetting nozzles/circulation ports/washing ports 274 to permit washing (of the inner surface of the casing 102 and more importantly the annulus outside the casing through the slots 108 formed therein by the cutting wheel 260) therethrough; and ii) secondly the lower set of bypass ports 297 have moved down below the level of the upper face of the piston head 243 and thus fluid within the throughbore 214 of the mandrel 213 of the slotting and jetting tool 210 is prevented from re-entering the throughbore of the piston cylinder sleeve 291 and thus pressure cannot start building up against the upper face of the piston head 243 and therefore the piston rod 244 and thus the cutting blade/wheel 260 are essentially prevented from moving from the retracted (i.e. the running in hole configuration) to the extended position (i.e. the activated configuration) and therefore the cutting blade/wheel 260 is held or restrained in the retracted position.

Accordingly, whilst the seating of the drop ball 268 will prevent fluid from flowing into the throughbore of the piston cylinder sleeve 291 and onto the upper face of the piston head 243, if the drop ball 268 were to be removed therefrom (e.g. by falling off the seat 270 particularly in a highly deviated wellbore 100), the cutting wheel 260 is still prevented from slotting once the washing procedure has commenced (with the dropping and seating of the drop ball 268).

It should importantly again be noted that the cutting wheel 260 is not reliant on the force created by the pressure of said fluid to stay engaged with the inner surface of the casing 102 or indeed is not reliant on said force created by the fluid pressure to cause the cutting/slotting action through the casing 102. Rather, in use, as the drill string 120 or other work string such as coiled tubing is moved upwards during operation of the method used for actuation of this second (inverted) embodiment of slotting and jetting tool 210 (by the operator picking up weight in order to actively pull the upper end of the work string 120 such as the coiled tubing string upwards at the surface (either for relatively deviated or relatively non-deviated wellbores 100) in order to lift the work string 120 and thus the slotting and jetting tool 210 up the wellbore 100) and as will be described subsequently, the cutting wheel 260 is not only kept forced outwards in the activated/radially extended outwards configuration due to the ramped shape of the slotted ramp 255, in that the slotted ramp 255 acts as a wedge to keep the cutting wheel 260 in the activated/radially extended outwards configuration, but the effect of the ramp 255 actually causes the cutting wheel 260 to be forced even further outwards and therefore to cause the slots 108 through the sidewall of the casing 102.

Accordingly, the inverted second embodiment of the slotting and jetting tool 210 disclosed herein can be considered to have two stages of activation:— a) a pressure activation stage in which fluid pressure is applied down the throughbore of the work string 120 from the surface of the wellbore 100 in order to act upon the upper face of the piston head 243 of the activation piston 240 in order to force the piston head 243 and thus the piston rod 244, wheel mount 250 and thus the wheel axle 264, wheel hub 262 and most importantly the cutting wheel 260 in an axially downwards direction and also a radially outwards direction such that the cutting wheel 260 will move from the stored/inactive/running in hole configuration shown in in FIGS. 24(*a*) to (*c*) to the activated/radially extended outwards and cutting or slotting configuration shown in FIGS. 27(*a*) and 27(*b*) although it should be noted that it is unlikely that the force applied by the fluid pressure alone will be sufficient to force the cutting wheel's 260 cutting tips through the sidewall of the casing 102 to form the slots 108;

AND b) a work string 120 movement activation stage—in which upwards movement due to lifting or pulling of the work string 120 by the operator at the surface will further force the cutting wheel 260 further down the ramp 255 and thus will be further forced radially outwards with significant levels of force sufficient to force the cutting wheel's 260 cutting tips through the sidewall of the casing 102 to form the slots 108.

In operation, this has a great advantage over conventional means of cutting through the sidewall of casing 102 downhole, where such conventional means typically rely on fluid pressure activated cutting means such as high speed cutting blades and the like, because much greater force can be applied to the cutting wheel 260 (and thus to the cutting tips thereof in order to form the slots in the casing 102 sidewall as previously described) given the very high pulling load that can be applied by the operator at the surface to e.g. a coiled tubing string.

The particular advantage of the inverted embodiment of the slotting and jetting tool 210 is that it can be used within both a drill string 120 but also particularly on the end of a coiled tubing string (not shown) which is particularly advantageous because it is much easier for an operator to apply a certain amount of pulling force to a coiled tubing string than it is to apply the same pushing force to a coiled tubing string (because coiled tubing is prone to buckling when pushed)—and coiled tubing run BHA's are attractive to operators due to their much lower running cost compared with drill string run BHA's.

The Slotting and Jetting Tool 210

Operation of the Second (Inverted) Embodiment of the Slotting and Jetting Tool 210

The second (inverted) embodiment of the slotting and jetting tool 210 may be incorporated into a BHA 1 instead of or in addition to (particularly if the two embodiments are arranged to have different activation pressures) the first embodiment of the slotting and jetting tool 10 and the skilled person will understand that it is operated in a similar manner thereto as hereinbefore described with the exception for the differences required given its inverted arrangement and therefore, whilst similarities will not be described, notable differences between the stages 1 to 45 hereinbefore described with reference to the first embodiment of the slotting and jetting tool 10 will now be described for ease of reference of the skilled person.

For example:—

Stage 3—FIG. 9 and FIG. 10

The BHA 1 incorporating the inverted slotting and jetting tool 210 is run into the wellbore 100 until it reaches the lower end of the lateral isolation placement depth which in general is the area of the casing to be slotted 130 and (ultimately) to be filled with isolation material 112 (such as cement or the like) in the subsequent steps.

The inverted slotting and jetting tool 210, when in the running in-hole (RIH) configuration, is as shown in FIGS. 24(*b*) and 24(*c*) where the activation piston 240 is in the non-activated position due to it not experiencing any significant and/or sufficient fluid pressure. The inverted slotting and jetting tool 210 can pass down through the wellbore fluid located in the throughbore 103 of the casing 102 and said fluid can pass through a bypass channel 298 (around the cutting wheel 260) formed in the mandrel 213 and out of the throughbore at the upper end of the inverted slotting and jetting tool 210.

Stage 5—FIG. 11

Prior to functioning the BHA 1 and in particular the slotting and jetting tool 210, the operator will likely run the BHA 1 to its maximum in use depth (i.e. just above the bridge plug 110) and will then pick the work string 120 back up such that the BHA 1 is pulled back up to be aligned with the bottom of the lateral isolation placement depth (i.e. the lowermost end or bottom of the slot jet area 106) and therefore the bottom of the area of the casing to be slotted 130.

Stage 7—FIG. 12

The operator can now activate the slotting blade or cutting wheel 260 by pressuring up the throughbore of the work string 120 to an appropriate pressure such as 1,500 psi and that fluid pressure will bypass the blade piston back pressure valve 292 and will act against the upper surface of the piston head 243. That increased pressure is calculated or predetermined to be sufficient to now act on the activation piston 240 such that it will move the piston head 243 and thus the piston rod 244 downwards (against the biasing force of the spring 245) such that the slotting blade or cutting wheel 260 is moved both downwards and radially outwards along the slotted ramp 255 from the configuration shown in FIGS. 24 (*b*) and 24 (*c*) to the extended configuration shown in FIGS. 27 (*a*) and 27(*b*) such that the slotting blade/cutting wheel 260 extends radially outwards firstly beyond the outer diameter of the mandrel 213 and then secondly is forced against the inner surface of the casing 102 and then thirdly, due to the wedge action provided by the slotted ramp 255 as the BHA 1 is moved upwards, punctures, cuts or slots through the side wall of the casing 102 in order to form a slot 108 therein due to the force being provided by the operator pulling up on the work string 120 at the surface of the wellbore. In addition, the slotting blade/cutting wheel 260 will further extend and puncture, cut and slot into and through the old cement 104 (and potentially the formation itself) located in the annulus between the outer surface of the casing and the borehole wall 105.

Stage 8—FIG. 12

After the operator has confirmation of the blades 260 full travel downwards and outwards and that casing 102 has begun to be slotted 108, the operator will continue to pressure up the string further to, for example, 1,750 psi pressure and in so doing will cause significant jetting of fluid through the single jetting nozzle 280 located directly vertically below and longitudinally aligned below the extended slotting blade/cutting wheel 260.

The pressurised fluid in the throughbore 214 of the mandrel 213 of the slotting and jetting tool 210 will therefore be forced out through the single jetting nozzle 280 in order to ensure that the washing fluid will wash through the slots 108 that have just been formed through the casing 102 as the slotting and jetting tool 210 is moved upwards in subsequent steps (for example in step 9) because the single jetting nozzle 280 is circumferentially and longitudinally aligned with the slotting blades/cutting wheel 260, and because it is located vertically below the cutting wheel 260 it will permit the pressurised cleaning/washing fluid to be jetted through the slots 108 that have just been formed.

Stage 9—FIG. 13

The operator will now pick up weight from the work string 120 such that the BHA 1 and more importantly the slotting and jetting tool 210 are moved upwards for example by 3 feet such that the slotting blades/cutting wheel 260 forms a number of longitudinally spaced apart slots 108 through the side wall of the casing 102 with its cutting tips as previously described.

Furthermore, the upper 20U and lower 20L pair of jetting cups (not shown in FIGS. 24 to 29 but which are preferably present in the BHA 1) ensure that the washing fluid which is highly pressurised to, for example 1,750 psi, is directed out through those slots 108 because the outer surfaces of the cups 20 are in sealed and sliding engagement with the inner surface of the casing 102.

Stage 15—FIG. 14

After the operator has confirmation of the slotting blade/cutting wheel 260 full travel downwards and radially outwards along the axially extending angled slotted ramp 255, and has confirmation that the casing 102 is being slotted 108, the operator will continue to pressure up the drill string 120 to 1,750 psi pressure again to start jetting from the single jetting nozzle 280 again.

Stage 16—FIG. 14

The operator will again move the BHA 1 and therefore the slotting and jetting tool 210 upwards within the slot jet area 130 of the wellbore 100 and will monitor the pressure of the washing fluid at surface for any fluctuation in that pressure for the same reasons as before.

Stage 17—FIG. 14

Once the operator has lifted the BHA 1 up 200 feet (or more if required) of travel and has therefore caused 200 feet of slot jet area 130 to be slotted 108, the operator will shut down the washing fluid pumps and will bleed off the washing fluid pressure.

Stage 18—FIG. 14

If for example the slot jet areas 130 is to be 200 feet, the operator will lower the work string 120 by 205 feet such that the BHA 1 is located 5 feet below the slot jet area 130 and therefore the cups 20 are compressed against the inner surface of the casing 102 at a location at which there are no slots therein.

Stage 20

The operator will move the BHA 1 and therefore the slotting and jetting tool 210 five feet up into the wellbore.

Final Jetting/Washing Procedure

Stage 27—FIG. 16—and FIGS. 29(*a*) and 29(*b*)

The operator will then drop a drop ball 268 down the throughbore of the drill string 120 and will allow gravity to pull the drop ball 268 to depth until it lands on the ball seat 270 held within the drop ball seat carrier 272 by means of centralising fins 294 (which permit fluid to flow from the surface down the throughbore of the work string and further flow therebetween and down into the throughbore 214 of the mandrel 213 when the ball 268 is not sitting upon the seat 270), and the pumping of fluid down the throughbore of the drill string 120 will of course greatly aid and speed the landing of the drop ball 268 on the ball seat 270. The throughbore of the work string 120 above the ball seat 270 and drop ball 268 is therefore blocked and fluid pressure applied at surface by the operator can therefore increase thereon.

Stage 28—FIGS. 29(*a*) and 29(*b*) and FIG. 17

The operator will then pressure up the washing fluid pumped into the throughbore of the work string 120 to a suitable pressure such as 2,000 or even 2,500 psi and in so doing will shear the set of shear pins 215 provided in the BHA 1, namely the set of shear pins 215 provided at the upper end of the slotting and jetting tool 210 holding the drop ball seat carrier 272 and thus the ball seat 270 and which are sheared because the fluid pressure builds up due to the drop ball 268 obturating the throughbore 214. The drop ball seat carrier 272 and thus the ball seat 270 drop to the position shown in FIGS. 29(*a*), (*b*) and (*c*) and in so doing the piston cylinder sleeve 291 moves downwards along with the sleeve cover 299 to thereby uncover the 360 degree set of jetting nozzles/circulation/washing ports 274 because it moves the sleeve cover 299 downwards thus uncovering the jetting nozzles/circulation/washing ports 274. Accordingly, the washing fluid flow is changed such that it will also and/or mainly flow through the throughbore 214 and out of the 360 degree set of jetting nozzles/circulation/washing ports 274 (and can't act upon the upper face of the piston head 243 due to the blade piston back pressure valve 292 blocking the fluid from acting upon the upper face of the piston head 243).

The rest of stages 29 to 34 of the washing procedure are largely the same for the inverted slotting and jetting tool 210 as hereinbefore described with reference to the first embodiment of the slotting and jetting tool 10.

Isolation/Cementing Procedure

This is largely the same for the inverted slotting and jetting tool 210 as hereinbefore described with reference to the first embodiment of the slotting and jetting tool 10, with the isolation material/cement 112 being pumped from surface down through the throughbore of the work string and if can exit the throughbore 214 of the mandrel 213 firstly and mainly through the jetting nozzles/circulation/washing ports 274 and also via the bypass channel out exit via the single jetting nozzle 280.

Embodiments of the present invention can be modified or improved without departing from the scope of the invention.

For example, both embodiments of the slotting and jetting tool 10; 210 have hereinbefore been described with having conventional suitable jetting cups 20 as being typically formed of relatively durable rubber material or the like. Such conventional cups 20 can be considered to be static jetting cups 20 in that they have a fixed outer diameter which is notably greater than the outer diameter of the widest portion of the mandrel 13; 213 of the slotting and jetting tool 10; 210 and which is also slightly greater than the inner diameter of the throughbore of the wellbore 100 and therefore the casing 102 into which the slotting and jetting tool 10; 210 and thus in use are designed to be squeezed into the inner throughbore of the casing 102 during running in and which will therefore always be in sealing contact with the inner throughbore of the casing 102 whilst the slotting and jetting tool 10; 210 is located therein. Accordingly, such static jetting cups do have the risk that hydraulic clock could occur if bridging (i.e. the fluid cannot pass up through the annulus 104) were to occur when the slotting and jetting tool 10; 210 is located within a slot jet area 130 of the casing 102 and it is jetting through the single jetting port 80; 280; and/or during washing with the 360 degree circulation/washing ports 74; 274 into the annulus 104 through the slots 108.

However, a preferred modification of either or both embodiments of slotting and jetting tool 10; 210 utilises an improved set of cups (not shown) which are available from RubberAtkins Limited of Aberdeen, UK (but other suppliers of cups are available such as those offered under the Guiberson™ brand by Oil States Industries of Arlington, Texas, USA.) where each of the improved cups is an active or actuable cup and which comprises an outer diameter which is no greater than the outer diameter of the widest portion of the mandrel 13; 213 of the slotting and jetting tool 10; 210 and therefore which is also notably less than the inner diameter of the throughbore of the wellbore 100 and therefore the casing 102 and thus in use are designed to be clear of the inner throughbore of the casing 102 during running in, slotting and jetting and which are arranged not to provide a seal with the inner surface of the casing 102 and this ensures that the preferred embodiments of slotting and jetting tool 10; 210 will not be able to experience hydraulic locking which could otherwise be caused if the jetting/cleaning/washing fluid cannot flow within the annulus 104 because e.g. bridging of the old cement therein has occurred.

However, the improved set of active or actuable cups are also arranged to be activated by a fluid pressure build up against them but only when the preferred embodiments of slotting and jetting tool 10; 210 are located within a blank (i.e. non-slotted section), in that the operator can increase the pressure of the fluid within the throughbore and that increase in pressure increases the fluid pressure in the annulus 27 (due to the fluid pressure being communicated through either or both of the 360 degree circulation/washing ports 74; 274 and/or the single jetting nozzle 80; 280 depending upon which stage of operation the tool 10; 210 is at).

That increase of the pressure of the fluid within the annulus 27 can't escape through e.g. slots 108 because the tool 10; 210 is in the blank section of the casing 102 and so the increase in fluid pressure acts upon said improved actuable cups piston area and:— i) firstly moves the cups to close the bypass channel around the inner surface (i.e. underneath) of the cups); and secondly ii) moves and/or expands the cups outwards such that the cups have an increasing outer diameter and which results in the outer diameter of the cups closing the annular gap between the outer surface of the mandrel 13; 213 and the inner surface of the casing 102; and iii) such expansion of the cups continues until the cups make contact with and thus seal against the inner surface of the casing 102, such that the annular gap between the outer surface of the mandrel 13; 213 and the inner surface of the casing 102 is now sealed.

Accordingly, said expansion and sealing of the cups when such preferred embodiments of slotting and jetting tool 10; 210 are located within a blank (i.e. non-slotted) section of the casing 102 now allows further pressure of fluid to be built up and the fluid that is exiting:— a) first the single jetting nozzle 80; 280; and possibly also b) secondly the (first) set of jetting nozzles/circulation ports 31; and possibly also c) thirdly the (second) set of 360 degrees jetting nozzles/circulation ports/washing ports 274 74; 274 allows the fluid pressure to quickly build up within the throughbore of the tool 10; 210 and thus causes the shearing of the respective shear pins 39 (if the tool 20; 210 is at stage 26—FIG. 15) or shear pins 15; 215 (if the tool 20; 210 is at Stage 28—FIGS. 7(*a*), 7(*b*), or FIGS. 29(*a*) and 29(*b*) and FIG. 17).

In other words, the said preferred embodiments of the slotting and jetting tool 10; 210 with the improved active cups requires to be moved into a blank (i.e. non-slotted) section of the casing 102 when the operator requires to move the tool 10; 210 to the appropriate stage as hereinbefore described in order to shear the respective shear pins 39 (if the tool 20; 210 is at stage 26—FIG. 15) or shear pins 15; 215 (if the tool 20; 210 is at Stage 28—FIGS. 7(*a*), 7(*b*), or FIGS. 29(*a*) and 29(*b*) and FIG. 17).

The invention claimed is:

1. A bottom hole assembly (BHA) to be run into a wellbore to be plugged and abandoned, the BHA comprising:

a slotting tool which further comprises:

an outer body having a throughbore;

connections to permit the outer body to be included in the BHA and in a work string having a through bore for sealed fluid communication with the throughbore of the outer body;

a slotting blade which is at least radially moveable towards and away from an inner surface of the well bore to be slotted; and an activation mechanism adapted to move the slotting blade between:

a running in hole configuration in which the slotting blade is relatively retracted; and an activated configuration in which the slotting blade is extended and in use is capable of creating at least one slot in the inner surface of the wellbore at a location in the wellbore to be plugged and abandoned;

wherein application of pressure to fluid in liquid form in the throughbore of the outer body is configured to act upon the activation mechanism to move the slotting blade from the running in hole configuration to the activated configuration;

wherein at least a portion of the slotting blade is configured to be forced through the inner surface of the wellbore to create the at least one slot therein by lowering the BHA down the wellbore by means of lowering the work string at the surface of the wellbore; and wherein the slotting tool is configured such that said lowering the BHA down the wellbore via the work string at the surface thereof also pushes the slotting blade downwards within the wellbore, and thereby further forces the slotting tool radially outwards, to thereby increase the slotting force of the said at least portion of the slotting blade against and/or through the inner surface of the wellbore; and wherein the BHA further comprises a jetting function in order to jet liquid fluid toward the inner surface of the wellbore;

wherein the outer body of the slotting tool further comprises a ramp formed therein wherein the ramp comprises an angled longitudinal axial length such that one end of the ramp is radially further inwards, with respect to the central longitudinal axis of the slotting tool, than the other end; and wherein the slotting tool is configured to be in a pushing slotting configuration in which the ramp is configured such that when the BHA is run into the wellbore, the said one radially further inwards end of the ramp is configured to be vertically below the said other radially further outwards end such that when the slotting tool is in the activated configuration, and when the slotting tool is pushed or lowered downwards within the wellbore, the slotting blade is also pushed or lowered downwards within the wellbore, and is thereby further forced radially outwards due to movement of the slotting blade along the ramp to thereby increase the slotting force of the said at least portion of the slotting blade against and/or through the inner surface of the wellbore.

2. A BHA according to claim 1, wherein the activation mechanism is selectively actuable to move the slotting blade radially:

a) away from the central longitudinal axis of the slotting tool and towards the casing to be slotted and into the activated configuration; and b) toward the central longitudinal axis of the slotting tool and away from the casing to be slotted and into the running in hole configuration in which the outer diameter of the slotting blade is relatively retracted towards or within the outer diameter of the outer body of the slotting tool.

3. A BHA according to claim 1, wherein the activation mechanism further comprises a piston and a cylinder, wherein the piston is located in the cylinder and is sealed thereto such that the piston can be forced to move by application of pressure of liquid fluid located in the through bore of the slotting tool.

4. A BHA according to claim 3, wherein the activation mechanism is configured such that an increase in the pressure of liquid fluid at the surface of the well bore by the operator results in an increase in the pressure of liquid fluid in the through bore of the slotting tool which forces the piston to move within the cylinder and which forces the slotting blade to move from said one end of the ramp to the said other end of the ramp and in so doing moves the slotting blade both vertically along the ramp in a direction parallel to the central longitudinal axis of the slotting tool and simultaneously in a direction radially outwards with respect to the central longitudinal axis of the slotting tool.

5. A BHA according to claim 1, wherein the activation mechanism further comprises a return device to assist in return of the slotting blade from the activated configuration into the running in hole or retracted configuration, upon reduction of the pressure of liquid fluid at the surface of the well bore by the operator.

6. A BHA according to claim 1, wherein the jetting function is configured to jet liquid fluid toward the slots created in the casing by the slotting blade.

7. A BHA according to claim 1, wherein the jetting function comprises at least one jetting port or orifice in the form of a jetting nozzle formed through the side wall of an outer body of the BHA and through which liquid fluid is selectively jetted by the operator.

8. A BHA according to claim 7, wherein the said at least one jetting port is longitudinally axially aligned with the slotting blade, such that the said at least one jetting port is located one of vertically above or below the slotting blade such that it is configured to jet washing fluid through the slots that have just been formed by the slotting blade as the slotting tool is moved vertically respectively downwards or upwards within the casing in use.

9. A BHA according to claim 7, wherein the slotting tool further comprises a plurality of jetting ports in the form of jetting nozzles formed around the circumference through the side wall of the outer body of the BHA such that they form a second set of jetting ports in the BHA.

10. A BHA according to claim 9, wherein the second set of jetting ports formed through the side wall of the outer body of the BHA are equi-spaced 360 degrees around the circumference of the slotting tool on the same plane perpendicular to the central longitudinal axis of the slotting tool such that all of the jetting ports in the second set will permit jetting of liquid fluid at the same vertical location in the well bore.

11. A BHA according to claim 9, wherein the second set of jetting ports are obturated when the slotting tool is in the running in hole configuration and can be selectively opened by the operator into fluid communication with liquid fluid located in the throughbore of the BHA by a port opening mechanism.

12. A BHA according to claim 11, wherein the port opening mechanism comprises a drop device seat member which is secured to the outer body of the slotting tool by a frangible device adapted to be sheared by dropping a drop device at surface such that when the drop device lands on the seat member, application of liquid fluid pressure at surface is transmitted to the liquid fluid located in the throughbore of the slotting tool and which acts upon the drop device and the seat member to shear the frangible device and which results in disconnection of the seat member from the outer body of the slotting tool thereby uncovering the second set of jetting ports and permitting fluid communication with the liquid fluid located in the throughbore of the slotting tool.

13. A BHA according to claim 1, wherein the BHA further comprises at least one upper sealing member located above the slotting tool and at least one lower sealing member located below the slotting tool, wherein the sealing members are configured to selectively seal against the inner surface of the casing when required to do so, and wherein the sealing members are configured to seal the annulus at their location between the outer surface of the BHA and the inner surface of the casing, and wherein the said sealing members are configured to provide a greater seal when the pressure of liquid fluid acting on their radially innermost faces increases.

14. A BHA according to claim 13, wherein the BHA further comprises a valve tool, located below the said lower sealing member, wherein the valve tool comprises:

a throughbore in sealed fluid communication with the throughbore of the rest of the BHA located above the valve tool; and a valve member operable within the throughbore of the valve tool.

15. A BHA according to claim 14, wherein the valve member permits liquid fluid located in the wellbore to pass upwards through the throughbore of the valve tool and continued passage upwards into the throughbore of the rest of the BHA and prevents fluid from flowing downwards through the throughbore of the valve tool.

16. A BHA according to claim 14, wherein the jetting function comprises at least one jetting port or orifice in the form of a jetting nozzle formed through the side wall of an outer body of the BHA and through which liquid fluid is selectively jetted by the operator, wherein the slotting tool further comprises a plurality of jetting ports in the form of jetting nozzles formed around the circumference through the side wall of the outer body of the BHA such that they form a first set of jetting ports in the BHA, wherein the valve tool comprises an outer body and a plurality of jetting ports or orifices in the form of jetting nozzles formed around the circumference and through the side wall of the outer body of the valve tool and which forms a second set of jetting ports in the BHA, wherein the jetting nozzles are configured in use to break up material located in the outer annulus.

17. A bottom hole assembly (BHA) according to claim 16, wherein the second set of jetting ports are formed through the side wall of the outer body of the valve tool and are equi-spaced 360 degrees around the circumference of the valve tool on the same plane perpendicular to the central longitudinal axis of the valve tool such that all of the jetting ports in the second set will permit jetting of liquid fluid at the same vertical location in the well bore, and wherein the second set of jetting ports are obturated when the valve tool is in the running in hole configuration and the valve member is permitted to be open to allow fluid located in the throughbore thereof to flow through the throughbore as the BHA is being run into the hole; and wherein the second set of jetting ports can be selectively opened by the operator into fluid communication with liquid fluid located in the throughbore of the valve tool by a valve tool port opening mechanism which comprises a slidable sleeve or housing to which the valve member is pivotably mounted, wherein the slidable sleeve is secured to the outer body of the valve tool by at least one frangible device which is selectively broken or sheared by applying a force to the slidable sleeve with respect to the outer body of the valve member.

18. A BHA according to claim 17, wherein when the valve member is closed by flow of fluid downwards through the throughbore of the valve tool and/or an increase in fluid pressure at surface which is transmitted to the liquid fluid located in the throughbore of the valve tool and which acts upon the said upper face of the valve member, and said increase in pressure applies a force to the upper end of the valve member and also the slidable sleeve which will break or shear the frangible device and which results in disconnection of the slidable sleeve from the outer body of the valve tool thereby uncovering the second set of jetting ports and permitting fluid communication to occur between the liquid fluid located in the throughbore of the valve tool and the second set of jetting ports.

19. A BHA according to claim 16, wherein at least one of, some of, most of or all of the single jetting port, first and second sets of jetting ports contain jets which permit fluid to pass therethrough:

a) in a circulation mode up to a certain pre-determined pressure; and b) once the required pre-determined pressure has been reached, the said jetting port will jet the fluid at a disruptive forceful rate sufficient to dislodge and/or disturb old cement or formation or other material;

wherein only the single jetting port permits fluid to pass therethrough in both of the aforementioned paragraphs a) and b) and the first and second sets of jetting ports are circulation ports which permit fluid to pass therethrough without restriction once they've been respectively opened.

20. A bottom hole assembly (BHA) according to claim 1, wherein the angle of the ramp is linear or constant along its longitudinal axial length.

21. A bottom hole assembly (BHA) according to claim 1, wherein the reaction force between the slotting blade and the inner surface of the wellbore causes the slotting blade to be forced further along the ramp in the vertically upwards direction from said one end of the ramp toward the said other end of the ramp and is thereby further forced radially outwards to thereby increase the slotting force of the said at least portion of the slotting blade against and/or through the inner surface of the wellbore.

22. A bottom hole assembly (BHA) according to claim 1, wherein the slotting blade is generally disc shaped and further comprises a castellated outer circumference such that the slotting blade comprises a number of cutting teeth in the form of cutting tips which are circumferentially equi-spaced around the circumference of the slotting blade and which are separated by gaps in order to increase the cutting force applied to the cutting teeth.

23. A method of forming slots in a wellbore suitable for plugging and abandoning the wellbore, the method comprising the steps of:

running a bottom hole assembly (BHA) comprising a slotting tool on a work string into the wellbore, the slotting tool comprising:

an outer body having a throughbore and a ramp formed in the outer body wherein the ramp comprises an angled longitudinal axial length such that one end of the ramp is radially further inwards, with respect to the central longitudinal axis of the slotting tool, than the other end; and connections to permit the outer body to be included in the BHA and in a work string having a throughbore for sealed fluid communication with the through bore of the outer body;

a slotting blade which is at least radially moveable towards and away from an inner surface of the wellbore to be slotted; and an activation mechanism adapted to move the slotting blade between:

a running in hole configuration in which the slotting blade is relatively retracted; and an activated configuration in which the slotting blade is extended and in use is capable of creating at least one slot in the inner surface of the well bore at a location in the wellbore to be plugged and abandoned;

wherein application of pressure to fluid in liquid form in the throughbore of the outer body is configured to act upon the activation mechanism to move the slotting blade from the running in hole configuration to the activated configuration, wherein at least a portion of the slotting blade is configured to be forced through the inner surface of the wellbore to create the at least one slot therein by at least one of raising or lowering the BHA respectively up or down the wellbore by means of respectively raising or lowering the work string at the surface of the wellbore, and wherein the BHA further comprises a jetting function in order to jet liquid fluid toward the inner surface of the wellbore; and pressuring up at surface fluid in liquid form and pumping said fluid in liquid form down the throughbore of the work string and applying said pressurised fluid to the activation mechanism to move the slotting blade along the ramp from the running in hole configuration to the activated configuration; and at least one of raising or lowering the BHA respectively up or down the wellbore via the work string at the surface thereof to force at least a portion of the slotting blade through the inner surface of the wellbore to form the at least one slot therein; and wherein said raising or lowering the BHA respectively up or down the wellbore via the work string at the surface thereof, pulls or pushes the slotting blade respectively upwards or downwards within the wellbore, and thereby moves the slotting blade further along the ramp and thereby further forces the slotting tool radially outwards, to thereby increase the slotting force of the said at least portion of the slotting blade against and/or through the inner surface of the wellbore.

24. A method of plugging and abandoning a wellbore according to claim 23, wherein the slotting tool further comprises:

an upper cup tool; and a lower cup tool.

25. A method of plugging and abandoning a wellbore according to claim 23, wherein the slotting tool is configured in one of a pulling or pushing slotting configuration at surface prior to being run into the wellbore.

26. A method of plugging and abandoning a wellbore according to claim 23, wherein the method further comprises:

pumping washing/cleaning fluid in liquid form from the surface through the throughbore of the work string at a pressure sufficient to pass through a single jetting nozzle of the slotting tool, in order to wash the washing/cleaning fluid through the one or more slots formed by the slotting tool.

27. A method of plugging and abandoning a wellbore according to claim 23, wherein the slotting tool further comprises a valve tool, and wherein the method further comprises:

increasing the pressure of the liquid fluid in the throughbore of the work string to a sufficient pressure such that a downwardly directed force is applied to a closed valve member of the valve tool and at least one frangible device is broken or sheared by said force and a slidable sleeve is moved thereby uncovering a set of jetting ports in the valve tool, thereby permitting increased volumes of washing/cleaning fluid in liquid form to be pumped from the surface through the throughbore of the work string at a pressure sufficient to pass through said set of jetting ports of the valve tool, in order to wash the washing/cleaning fluid through the one or more slots formed by the slotting tool.

28. A method of plugging and abandoning a wellbore according to claim 23, wherein the method further comprises:

dropping a drop device at surface into the throughbore of the work string and landing the drop device on a drop device seat member of the slotting tool.

29. A method of plugging and abandoning a wellbore according to claim 28, wherein the method further comprises:

increasing the pressure of the liquid fluid in the throughbore of the work string to a sufficient pressure such that a downwardly directed force is applied to the drop device and drop device seat member whereby at least one frangible device acting between the drop device seat member and the outer body of the slotting tool is broken or sheared by said force and the drop device seat member and drop device are moved thereby opening the throughbore of the slotting tool by means of uncovering a set of jetting ports in the slotting tool, thereby permitting increased volumes of washing/cleaning fluid in liquid form to be pumped from the surface through the throughbore of the work string at a pressure sufficient to pass through said set of jetting ports of the slotting tool, in order to wash the washing/cleaning fluid through the one or more slots formed by the slotting tool.

30. A method of plugging and abandoning a wellbore according to claim 23, wherein the method further comprises:

pumping isolation material from surface into the throughbore of the work string to fill the required area of the wellbore including both the throughbore of the casing and the washed clean annulus behind the casing with said isolation material to a sufficient depth.

31. A method of plugging and abandoning a wellbore according to claim 30, wherein the method further comprises:

pull the workstring upwards until the BHA is located above the uppermost slots formed by the slotting tool and increasing the pressure of said pumped isolation material at surface into the throughbore of the work string to a sufficient pressure such that a downwardly directed force is applied to the drop device and seat member until at least one frangible device acting between a ball seat and the seat member is broken or sheared by said force and the drop device and the ball seat are moved thereby opening the throughbore of the slotted tool to the throughbore of the BHA located below the slotted tool in order to open up circulation of isolation material below the slotted tool and out through the first set of circulation ports in order obtain circulation of isolation material below the slotting tool.

32. A method of plugging and abandoning a wellbore according to claim 30, wherein the method further comprises:

pulling said BHA and said work string out of the hole and permitting the isolation material to set.

33. A bottom hole assembly (BHA) to be run into a wellbore to be plugged and abandoned, the BHA comprising:

a slotting tool which further comprises:

an outer body having a throughbore;

connections to permit the outer body to be included in the BHA and in a work string having a throughbore for sealed fluid communication with the throughbore of the outer body;

a slotting blade which is at least radially moveable towards and away from an inner surface of the wellbore to be slotted; and an activation mechanism adapted to move the slotting blade between:

a running in hole configuration in which the slotting blade is relatively retracted; and an activated configuration in which the slotting blade is extended and in use is capable of creating at least one slot in the inner surface of the wellbore at a location in the wellbore to be plugged and abandoned;

wherein application of pressure to fluid in liquid form in the throughbore of the outer body acts upon the activation mechanism to move the slotting blade from the running in hole configuration to the activated configuration;

wherein at least a portion of the slotting blade is forced through the inner surface of the wellbore to create the at least one slot therein by raising the BHA up the wellbore; and wherein the slotting tool is configured such that said raising the BHA up the wellbore pulls the slotting blade upwards within the wellbore, and thereby further forces the slotting tool radially outwards, to thereby increase the slotting force of the said at least portion of the slotting blade against and/or through the inner surface of the wellbore;

wherein the BHA further comprises a jetting function in order to jet liquid fluid toward the inner surface of the wellbore;

wherein the outer body of the slotting tool further comprises a ramp formed therein wherein the ramp comprises an angled longitudinal axial length such that one end of the ramp is radially further inwards, with respect to the central longitudinal axis of the slotting tool, than the other end; and wherein the slotting tool is configured to be in a pulling slotting configuration in which the ramp is configured such that when the BHA is run into the wellbore, the said one radially further inwards end of the ramp is configured to be vertically above the said other radially further outwards end such that when the slotting tool is in the activated configuration, and when the slotting tool is pulled or lifted upwards within the wellbore, the slotting blade is also pulled or lifted upwards within the wellbore, and is thereby further forced radially outwards to thereby increase the slotting force of the said at least portion of the slotting blade against and/or through the inner surface of the wellbore.

34. A bottom hole assembly (BHA) according to claim 33, wherein the angle of the ramp is linear or constant along its longitudinal axial length.

35. A bottom hole assembly (BHA) according to claim 33, wherein the reaction force between the slotting blade and the inner surface of the wellbore causes the slotting blade to be forced further along the ramp in the vertically downwards direction from said one end of the ramp toward the said other end of the ramp and is thereby further forced radially outwards to thereby increase the slotting force of the said at least portion of the slotting blade against and/or through the inner surface of the wellbore.

36. A bottom hole assembly (BHA) according to claim 33, wherein the slotting blade is generally disc shaped and further comprises a castellated outer circumference such that the slotting blade comprises a number of cutting teeth in the form of cutting tips which are circumferentially equi-spaced around the circumference of the slotting blade and which are separated by gaps in order to increase the cutting force applied to the cutting teeth.

37. A bottom hole assembly (BHA) to be run into a wellbore to be plugged and abandoned, the BHA comprising:

a slotting tool which further comprises:

an outer body having a throughbore;

connections to permit the outer body to be included in the BHA and in a work string having a throughbore for sealed fluid communication with the throughbore of the outer body;

a slotting blade which is at least radially moveable towards and away from an inner surface of the wellbore to be slotted; and an activation mechanism adapted to move the slotting blade between:

a running in hole configuration in which the slotting blade is relatively retracted; and an activated configuration in which the slotting blade is extended and in use is capable of creating at least one slot in the inner surface of the wellbore at a location in the wellbore to be plugged and abandoned;

wherein application of pressure to fluid in liquid form in the throughbore of the outer body acts upon the activation mechanism to move the slotting blade from the running in hole configuration to the activated configuration;

wherein at least a portion of the slotting blade is forced through the inner surface of the wellbore to create the at least one slot therein by at least one of raising or lowering the BHA respectively up or down the wellbore; and wherein the slotting tool is configured such that said raising or lowering the BHA respectively up or down the wellbore, pulls or pushes the slotting blade respectively upwards or downwards within the wellbore, and thereby further forces the slotting tool radially outwards, to thereby increase the slotting force of the said at least portion of the slotting blade against and/or through the inner surface of the wellbore;

wherein the BHA further comprises a jetting function in order to jet liquid fluid toward the inner surface of the wellbore;

wherein the BHA further comprises at least one upper sealing member located above the slotting tool and at least one lower sealing member located below the slotting tool, wherein the sealing members are configured to selectively seal against the inner surface of the casing when required to do so, and wherein the sealing members are configured to seal the annulus at their location between the outer surface of the BHA and the inner surface of the casing, and wherein the said sealing members are configured to provide a greater seal when the pressure of liquid fluid acting on their radially innermost faces increases;

wherein the BHA further comprises a valve tool, located below the said lower sealing member, wherein the valve tool comprises:

a throughbore in sealed fluid communication with the throughbore of the rest of the BHA located above the valve tool; and a valve member operable within the throughbore of the valve tool;

wherein the jetting function comprises at least one jetting port or orifice in the form of a jetting nozzle formed through the side wall of an outer body of the BHA and through which liquid fluid is selectively jetted by the operator, wherein the slotting tool further comprises a plurality of jetting ports in the form of jetting nozzles formed around the circumference through the side wall of the outer body of the BHA such that they form a first set of jetting ports in the BHA;

wherein the valve tool comprises an outer body and a plurality of jetting ports or orifices in the form of jetting nozzles formed around the circumference and through the side wall of the outer body of the valve tool and which forms a second set of jetting ports in the BHA, wherein the jetting nozzles are configured in use to break up material located in the outer annulus;

wherein the second set of jetting ports are formed through the side wall of the outer body of the valve tool are equi-spaced 360 degrees around the circumference of the valve tool on the same plane perpendicular to the central longitudinal axis of the valve tool such that all of the jetting ports in the second set will permit jetting of liquid fluid at the same vertical location in the wellbore, and wherein the second set of jetting ports are obturated when the valve tool is in the running in hole configuration and the valve member is permitted to be open to allow fluid located in the throughbore thereof to flow through the throughbore as the BHA is being run into the hole;

wherein the second set of jetting ports can be selectively opened by the operator into fluid communication with liquid fluid located in the throughbore of the valve tool by a valve tool port opening mechanism which comprises a slidable sleeve or housing to which the valve member is pivotably mounted, and wherein the slidable sleeve is secured to the outer body of the valve tool by at least one frangible device which is selectively broken or sheared by applying a force to the slidable sleeve with respect to the outer body of the valve member.

* * * * *